US011148165B2

(12) United States Patent
Fuller

(10) Patent No.: US 11,148,165 B2
(45) Date of Patent: Oct. 19, 2021

(54) WATER ON WALL DISPLAY

(71) Applicant: WET, Sun Valley, CA (US)

(72) Inventor: Mark Fuller, Sun Valley, CA (US)

(73) Assignee: WET, Sun Valley, CA (US)

( * ) Notice: Subject to any disclaimer, the term of this patent is extended or adjusted under 35 U.S.C. 154(b) by 0 days.

(21) Appl. No.: 15/436,718

(22) Filed: Feb. 17, 2017

(65) Prior Publication Data

US 2017/0232464 A1 Aug. 17, 2017

Related U.S. Application Data

(60) Provisional application No. 62/296,577, filed on Feb. 17, 2016.

(51) Int. Cl.

| | |
|---|---|
| ***B05B 17/08*** | (2006.01) |
| ***B05B 1/20*** | (2006.01) |
| ***B05B 9/04*** | (2006.01) |
| ***B05B 12/02*** | (2006.01) |
| *B05B 12/04* | (2006.01) |

(52) U.S. Cl.

CPC ..... *B05B 17/085* (2013.01); *B05B 1/20* (2013.01); *B05B 9/0423* (2013.01); *B05B 12/02* (2013.01); *B05B 12/04* (2013.01)

(58) Field of Classification Search

CPC ..... B05B 17/085; B05B 9/0423; B05B 12/02; F21W 2121/02

USPC ..... 239/17, 18, 23; 362/96; 428/13

See application file for complete search history.

(56) References Cited

U.S. PATENT DOCUMENTS

| | | | | | |
|---|---|---|---|---|---|
| 2,034,792 | A * | 3/1936 | Bergman | F21S 8/00 | 239/18 |
| 4,955,540 | A * | 9/1990 | Fuller | B05B 1/10 | 239/20 |
| 5,067,653 | A * | 11/1991 | Araki | G03B 21/608 | 239/18 |
| 5,234,728 | A * | 8/1993 | Chiang | B44F 1/00 | 239/18 |
| 5,899,634 | A * | 5/1999 | Lochtefeld | A63C 19/00 | 405/79 |
| 6,135,604 | A * | 10/2000 | Lin | H05B 45/20 | 362/101 |
| 6,261,186 | B1 * | 7/2001 | Henry | A63G 1/12 | 239/16 |
| 6,276,612 | B1 * | 8/2001 | Hall | B05B 17/08 | 239/101 |
| 6,611,114 | B1 * | 8/2003 | Yen | A63J 17/00 | 315/360 |
| 6,921,023 | B1 * | 7/2005 | Bright | A01K 63/006 | 239/17 |
| 7,775,457 | B2 * | 8/2010 | Schnuckle | B05B 17/08 | 239/12 |
| 8,225,539 | B2 * | 7/2012 | Beebe | G09F 15/0012 | 40/406 |
| 8,333,331 | B1 * | 12/2012 | Fuller | B05B 1/265 | 239/17 |

(Continued)

*Primary Examiner* — Joseph A Greenlund
(74) *Attorney, Agent, or Firm* — Maceiko IP

(57) ABSTRACT

A water display is described including a wall or other structure upon which streams of water are shot. The direction, velocity, pressure and flow rate of the water streams may be varied to provide entertaining visual effects, which may also be choreographed with music, lighting or other features.

17 Claims, 22 Drawing Sheets

(56) References Cited

U.S. PATENT DOCUMENTS

| | | | | |
|---|---|---|---|---|
| 8,511,828 | B2 * | 8/2013 | Fuller | G09F 19/18 353/28 |
| 8,813,765 | B2 * | 8/2014 | Petit | B60S 3/04 134/123 |
| 9,427,763 | B2 * | 8/2016 | Fuller | G09F 19/226 |
| 2003/0094509 | A1 * | 5/2003 | Venuto, Sr. | A45D 44/00 239/200 |
| 2006/0208369 | A1 * | 9/2006 | Hayden | B05B 17/085 261/36.1 |
| 2007/0205300 | A1 * | 9/2007 | Plut | G03B 21/16 239/17 |
| 2008/0135639 | A1 * | 6/2008 | Winters | A23N 12/02 239/8 |
| 2008/0217424 | A1 * | 9/2008 | Yang | B05B 17/085 239/18 |
| 2010/0187325 | A1 * | 7/2010 | Houstoun | B05B 17/085 239/17 |
| 2014/0240958 | A1 * | 8/2014 | Fuller | B05B 17/085 362/96 |
| 2014/0312139 | A1 * | 10/2014 | Fuller | B05B 17/08 239/17 |
| 2015/0041554 | A1 * | 2/2015 | Aguilera Sanchez | B05B 17/08 239/12 |
| 2017/0232464 | A1 * | 8/2017 | Fuller | B05B 9/0423 239/18 |

* cited by examiner

WATER ON WALL DISPLAY

CROSS REFERENCE TO RELATED APPLICATIONS

This application claims the benefit of U.S. Provisional Application No. 62/296,577, filed Feb. 17, 2016, the contents of which are incorporated herein by reference.

FIELD OF THE INVENTION

The current invention generally relates to fountains and displays involving water or other fluids that interact with walls or other structures to provide visual effects, including displays where water is shot towards a transparent, translucent or other type wall or structures.

BACKGROUND OF THE INVENTION

Displays that include water fountains and water nozzles, lighting and other visual effects have existed for some time. For example, the water and light display in front of the Bellagio Hotel has entertained millions of people for years.

However, many existing water and light displays have limitations and other shortcomings.

As such, there continues to be a need for new and innovative displays that introduce new variables into the display to provide enhanced visual effects. For example, many existing water displays include water nozzles that shoot water into the air, but do not involve walls or other structures with which the water may interact. Accordingly, there is a need for a display wherein water or other liquid may interact with walls or other structures.

SUMMARY OF THE INVENTION

In a first aspect of the invention, a display is described including water and a structural component. The structural component may include a wall that may be glass or some other transparent or translucent material. Water may be shot at the wall or other structure to provide a visual effect such as a waterfall or a cascading wall of water. The angle at which the water is shot towards the wall and/or the flow rate of the water being shot may be varied, so that the visual effect may also be varied.

In another aspect of the invention, water may be shot from a manifold assembly including one or more nozzles to shoot water onto the wall or other structure. In a preferred embodiment, the manifold may comprise a pipe or tube having a number of water nozzles extending along its length. In this manner, a number of water streams may be shot at the wall or other structure. The manifold may also be rotated along its axis so that the direction of the water nozzles relative to the wall is varied. Multiple such manifolds may be used in the current invention which, when rotated, may provide many different streams of water striking the wall at different angles and/or patterns.

In another aspect of the invention, the placement of the water nozzles on the manifold(s) may be varied to provide different visual effects. For example, the nozzles may be located a certain distance apart and shoot water at the same angle. Alternatively, the direction of the nozzles may be varied so that water strikes the wall or other structure at different angles for a given manifold position.

In another aspect of the invention, the water nozzles may be individually controlled so that their directions may change relative to each other. Such water nozzles may also be connected to individual bases as opposed to all being connected to a manifold. The flow rate may also be changed for a number of nozzles at one time or for individual nozzles. The flow rate may be varied to achieve laminar or turbulent flow.

Another aspect of the invention involves the wall or other structure that water is shot at. For example, the wall may comprise glass which may provide a cascading and shimmering effect as the water impinges on the wall and flows downward. With a glass wall, observers may be located on the side of the wall opposite from the water nozzles. In this manner, the observers may be up close to the display itself. Alternatively, the observers may observe from the same side as the water nozzles. The glass wall may be clear, textured or translucent. With a textured surface, the appearance of the water interacting with the wall may be varied.

Another aspect of the invention involves the structure at which water is shot. For example, glass walls may be located adjacent to each other so that they form a tunnel through which observers may walk.

Yet another aspect of the invention involves an additional structural component that may be located separately from the first structural component. The additional structural component may include an additional wall that may be glass or some other transparent or translucent material. Water may be released from above the wall onto the front or back surfaces of the wall such that the water may flow downward upon the wall surfaces forming water flow effects. Different types of water formations may be delivered to the wall such as water droplets, water streams, water droplet blooms, water blooms, and other types of shapes and formations of water.

In one aspect of this additional structural component, water may be released onto the additional wall by water holes. In another aspect of this additional structural component, water may be emitted onto the additional wall by water shooters or nozzles. In yet another aspect of this additional structural component, water may be released onto the wall by a water fall component. The flow rate and water pressure of the emitted water may be controlled by one or more water pumps.

In another aspect of the invention, water may be released in close proximity to the additional wall to fall through the air in front of or behind the additional wall. Water may be release by water holes, water droppers, water nozzles and other types of water deliver devices. The flow rate and water pressure of the emitted water may be controlled by one or more water pumps.

Other aspects of the invention are discussed herein.

DETAILED DESCRIPTION OF THE PREFERRED EMBODIMENTS

Figure 1:
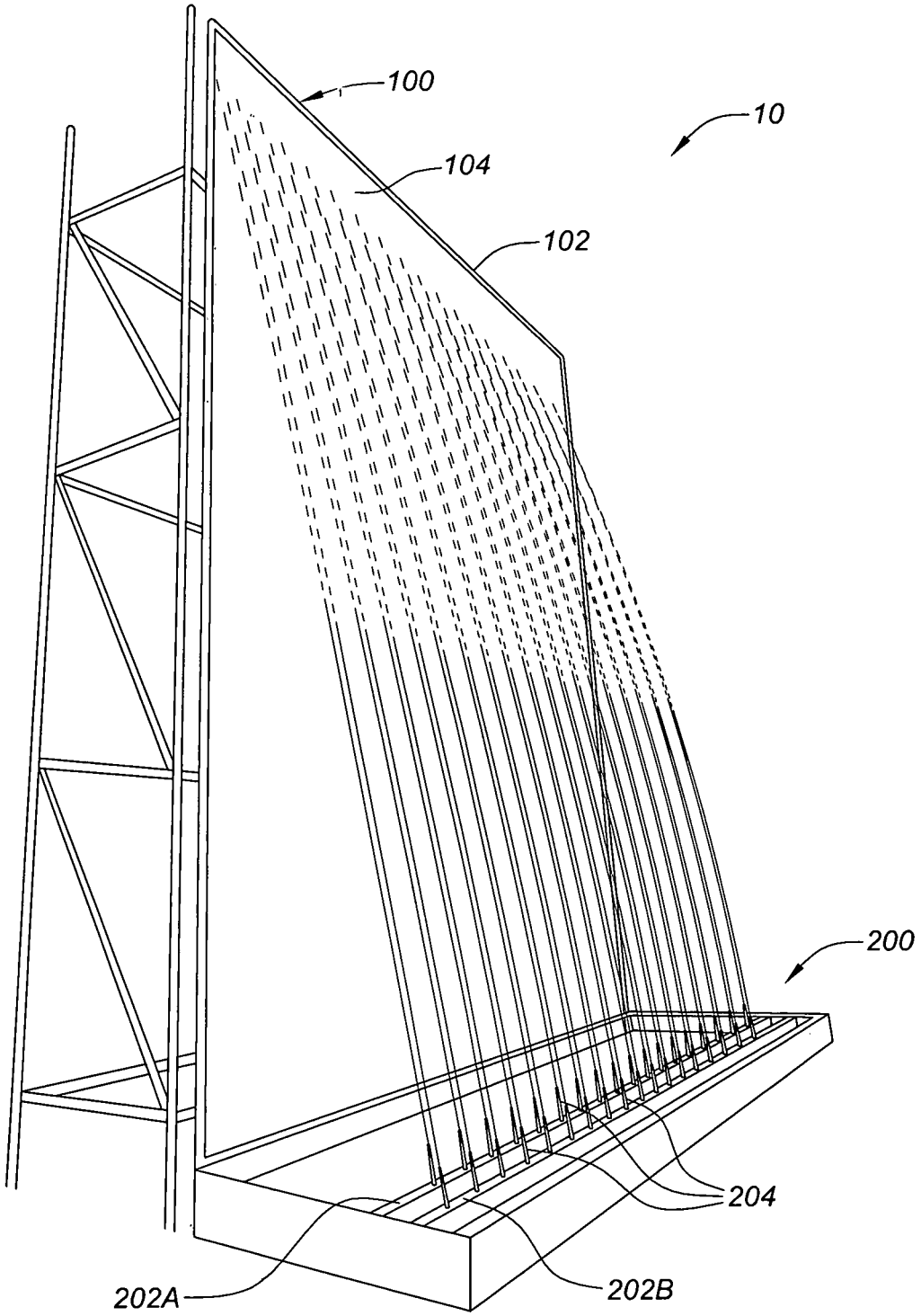
FIG. 1 is a perspective view of a water display including a wall and water nozzles.

The display 10 of the current invention and the visual effects that it may produce are now described with reference to the figures. Where the same or similar components appear in more than one figure, they are identified by the same or similar reference numerals. The invention is described herein with reference to water. However, other liquids and combinations thereof are within the scope of the invention.

In general, display 10 provides dramatic visual effects by applying water to the surface of a structure such as a wall. For example, display 10 may shoot water onto a transparent wall from different distances and angles to be viewed by onlookers on either side of the wall.

FIG. 1 shows an embodiment of display 10 installed in an outdoor area. Display 10 may be installed outside hotels, public buildings or in parks, or in atriums, lobbies or other indoor locations. As such display 10 may provide an attraction to these buildings and spaces. Display 10 may also be included in existing water and/or lighting displays to provide enhanced visual effects. As shown in FIG. 1, display 10 may be relatively large and may extend upward tens of feet. To this end, display 10 may be formed using a side of a building as the wall. In any event, display 10 may be of various sizes and the current invention is not limited to the sizes of displays shown in the figures.

In general, display 10 may include wall or structure 100 and water delivery assembly 200 which shoots water at wall or other structure 100. Light assemblies (not shown) which may be particularly suitable for use at night, and other accessories or features (not shown) may also be included in display 10.

As discussed in more detail below, water may shoot from water delivery assembly 200 onto wall assembly 100 from different locations and angles, and at different water pressures or flow rates to create a dramatic visual effect. Wall 100 may include water wall 102 with front surface 104 on which the water engages wall 102. Wall 102 may be formed of a transparent material such as glass so that water hitting water wall 102 may be viewed from either side of wall 102. In addition, illumination from lighting assemblies (not shown) may be added to further enhance the visual effect of the display.

Depending on the angle and water pressure at which the water is shot onto water wall 102, the water may adhere to and generally flow down water wall 102, or may splash off of water wall 102. Changing the angles and pressure of the water shot at water wall 102 may alter the appearance of the water as it engages wall 102 and flows down thus providing an entertaining water display effect.

In the embodiment of FIG. 1, water delivery assembly 200 includes manifolds 202A, 202B which each include a plurality of nozzles 204. As shown, manifolds 202A, 202B may be positioned in front of wall assembly 100 so that they shoot water onto front surface 104 of water wall 102. As described in later sections, water delivery assembly 200 may also be positioned behind, to the side, above or in any other position or in any combination of these positions with respect to wall assembly 100.

Given its size, display 10 may provide a very dramatic entrance to a building such as a hotel to provide a very unique experience when entering the building that may serve as an attraction to the building itself. To this end, where the building is a hotel or other brand establishment, display 10 may enhance the brand. As noted above, display 10 of the current invention is not limited to large installations. For example, display 10 may be configured to be smaller and/or portable. To this end, a portable embodiment of the current invention may be temporarily set up for concerts, parks, museums or other events or locations.

Display 10 is now further described with reference to FIG. 2. As shown, display 10 may include wall assembly 100 and water delivery assembly 200, which may include manifold 202 having a plurality of nozzles 204. Display 10 may also include lighting assemblies 203 that may be positioned on either side of water wall 102. Water may be supplied to water manifold pipe 202 and water nozzles 204 from water supply 206 through water supply pipe 208. Water may then shoot upward from water nozzles 204 onto front surface 104 of water wall 102. As will be described in detail in sections below, water nozzles 204 may be controllable such that the launch angle of water shot from water nozzles 204 towards water wall 102, and thus the distance the water travels before hitting the wall and the wall location at which the water hits the wall, may be controllably varied. In addition, the water pressure of water shot by water nozzles 204, and therefore the exit velocity at which the water emanates from nozzles 204 may also be controllably varied by varying the water flow rate and/or water pressure into nozzles 204. For example, the incoming flow rate or pressure may be varied by varying the rotational speed of the pertinent pump or by variable or programmable valves. By controlling the launch angle, the velocity of water shot by water nozzles 204 and the distance between water nozzles 204 and front surface 104, the water may be aimed to intersect water wall 102 at different locations upon the wall 102 and at different angles and velocities.

Upon contacting front surface 104 of water wall 102, the water may generally may generally adhere and flow down front surface 104 where the water pressure is not exceeding large. Alternatively, where water pressure is increased, the water may splash off front surface 104 upon contact. In either situation, it is preferred that water is received by water trough 106. Water trough 106 may generally have a width that may correspond with the width of water wall 102 and may be generally positioned at the front base of water wall 102 and joined with front surface 104 such that water flowing down front surface 104 or splashing off of it is generally caught by water trough 106. Water received into water trough 106 may then be treated and returned to water supply 206 through water return pipe 210 to be recirculated to water manifold pipe 202 as desired.

Water wall assembly 100 is now further described with reference to FIG. 2. Water wall 102 may be configured in a number of different ways and may comprise various materials. In a preferred embodiment, water wall 102 may be generally rectangular in shape and may extend generally upright tens of feet. However, other 2-dimensional and 3-dimensional shapes may be used as described below. For example, water wall 102 may include front surface 104 that may be transparent or translucent, such that water intersecting wall 102 may be viewed from both the front side of water wall 102 in front of front surface 104, and rear side 105 of water wall 102 opposite front surface 104.

Observers may view water wall 102 from the sides or from above, for example, from the balcony of their hotel room. Front surface 104 may also be frosted or tinted of different colors. To this end, front surface 104 may comprise glass, acrylic, polycarbonate or other suitable materials and combinations thereof. Being transparent or translucent may also allow water splashing off of or flowing down wall 102 to be more easily seen by observers, especially when illuminated by lighting assemblies.

As an alternative, front surface 104 may be a solid color or opaque. In this embodiment, water wall 102 may be formed of materials such as stone, metal, mirrored materials or other suitable materials. In addition, front surface 104 may comprise any combination of transparent or translucent, and solid or opaque materials. As a further alternative, front surface 102 may comprise a generally solid structure, a sheet of material that may be rolled down from the top and secured into place, a mesh or any combination thereof. Accordingly, it should be noted that water wall 110 of the current invention is not limited to a solid wall in the conventional sense. Instead, water wall 110 may comprise any configuration on which water may be shot upon and travel downward.

Front surface 104 of water wall 102 may also be textured with ridges, bumps or other types of texturing, and such texturing may cover the majority of front surface 104 or only parts or subsections of front surface 104. Water traveling over textured areas of front surface 104 may appear visually different to viewers of water wall 102 compared to water traveling over areas of front surface 104 that may not include texturing. In addition, front surface 104 may include a variety of different types of texturing with each type of texturing positioned in different areas or subsections of front surface 104, or in patterns or shapes upon front surface 104, such that water cascading down front surface 104 and traveling over the one type of texturing may appear different compared to water traveling over a different type of texturing. To this effect, front surface 104 may include different texturing that may form patterns or pictures of different abstract or recognizable forms or shapes. For example, front surface 104 may include texturing that may form the logo of a brand, or the name of the hotel where display 10 may be installed.

In addition, front surface 104 may include channels, ridges, laser etchings or other similar types of elements that may act to guide water that may be traveling down front surface 104 to form different shapes as the water passes down front surface 104. In the example from above, these channels or ridges may form the name and logo of the brand that may own or sponsor display 10, such that water running down front surface 104 of water wall 102 may form the individual letters of the name of the brand along with the logo symbol.

Water wall assembly 100 may also include support structure 108 that may generally support water wall 102 in a secure and stable manner. To this end, support structure 108 may include various beams, struts or other members, such as vertical beams 110, horizontal beams 112, diagonal beams 114 as well as other types of beams configured in a manner that may provide adequate support to water wall 102. Support structure 108 may also include base 116 with an adequate girth, weight and footprint to provide stability and to hold support structure 108 securely in place while supporting water wall 102. Base 116 may include a portion that may be buried underground and secured with concrete, may be attached to a concrete foundation or may be anchored to the ground using other methods.

To this end, lower ends of vertical beams 110 may be attached to base structure 108, and may run along and be attached to, the left and right sides of water wall 102 thereby providing vertical support to wall 102. Vertical beams 110 may also be positioned in the interior area of water wall 102, as depicted by the vertical dashed lines in FIG. 2, to provide additional vertical support to these regions of water wall 102. As an alternative, display 10 need not include base 116 and vertical beams 110 may each be anchored to the ground individually or otherwise configured to provide support.

Left ends and right ends of horizontal beams 112 may attach to vertical beams 110 on the left and right sides of water wall 102 respectively, and may be attached to water wall 102 to supply horizontal support thereto. While FIG. 2 depicts one horizontal beam 112 generally attached to the top edge of water wall 102, and two horizontal beams 112 (depicted as dashed lines in FIG. 2) running behind water wall 102 between left and right vertical beams 110, other numbers of horizontal beams may be used. Diagonal beams 114 may be placed between horizontal beams 112, between vertical beams 110 or between any combination of vertical beams 110, horizontal beams 112 or any other type of beam or component of support structure 108 as necessary for added support.

Figure 11:
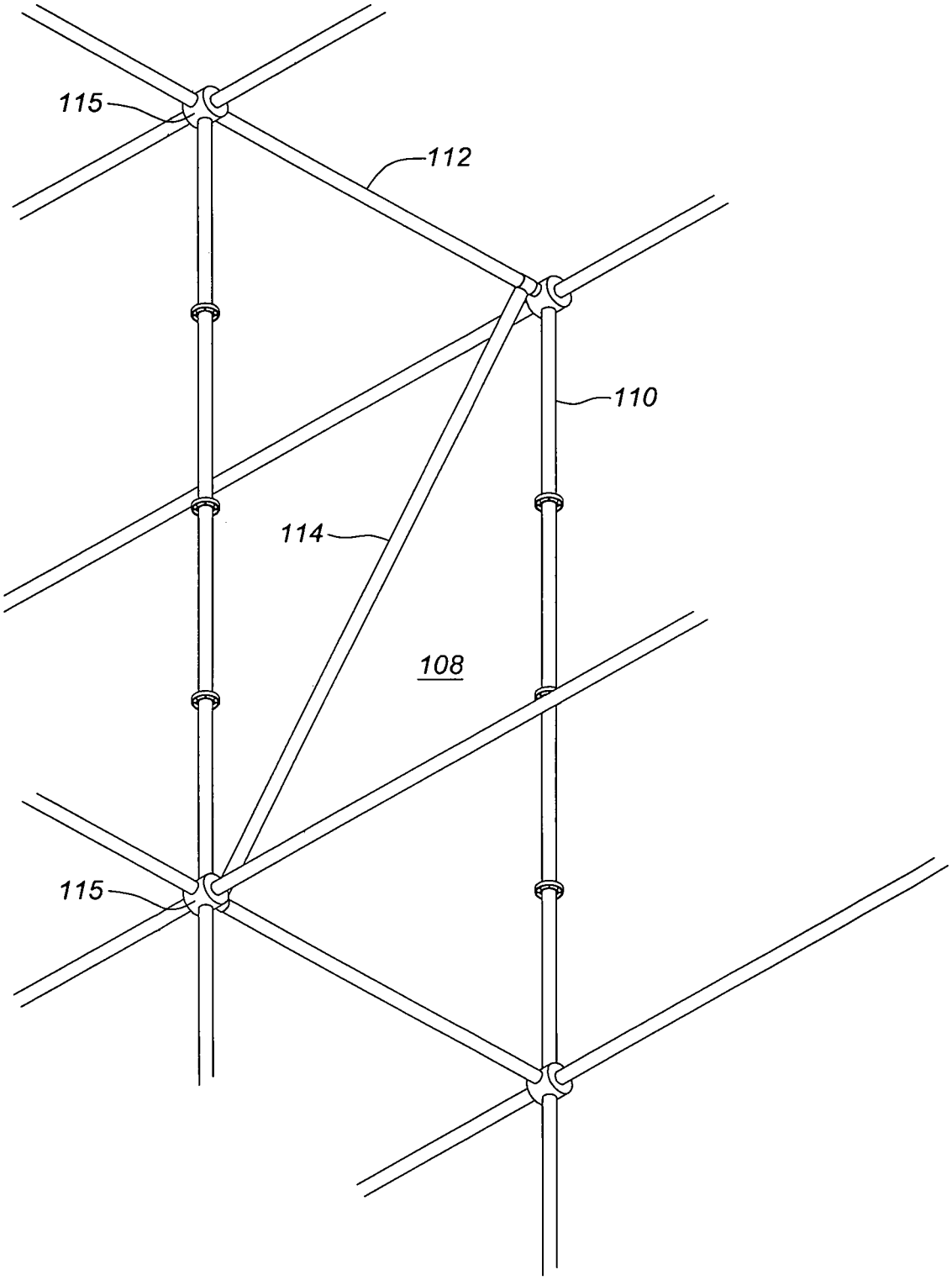
FIG. 11 shows a support structure.
Figure 12:
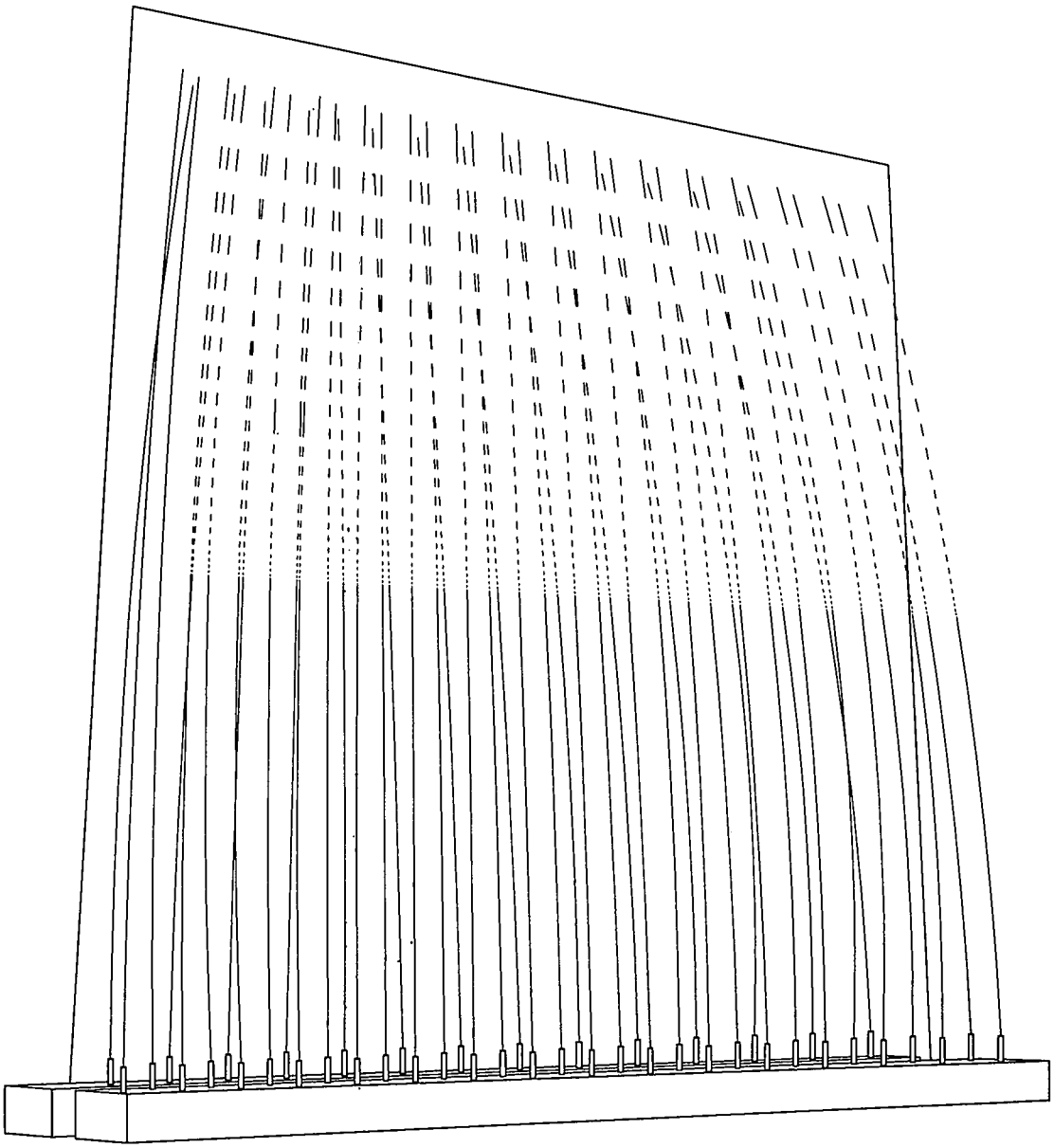
FIGS. 12-15 show a display with lighting.
Figure 13:
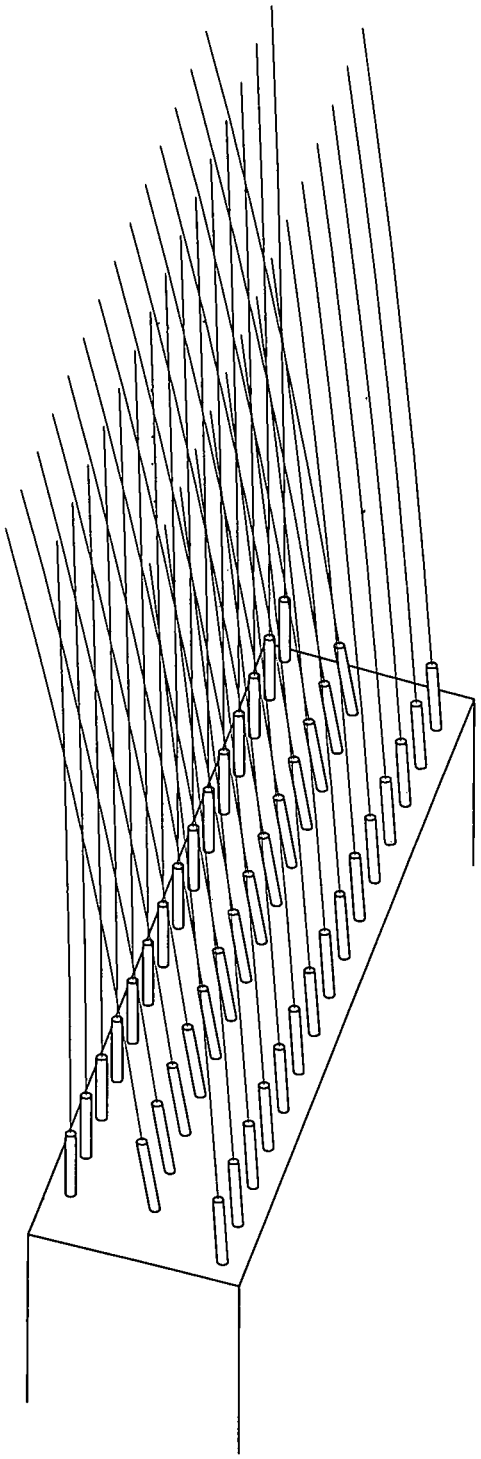
Figure 14:
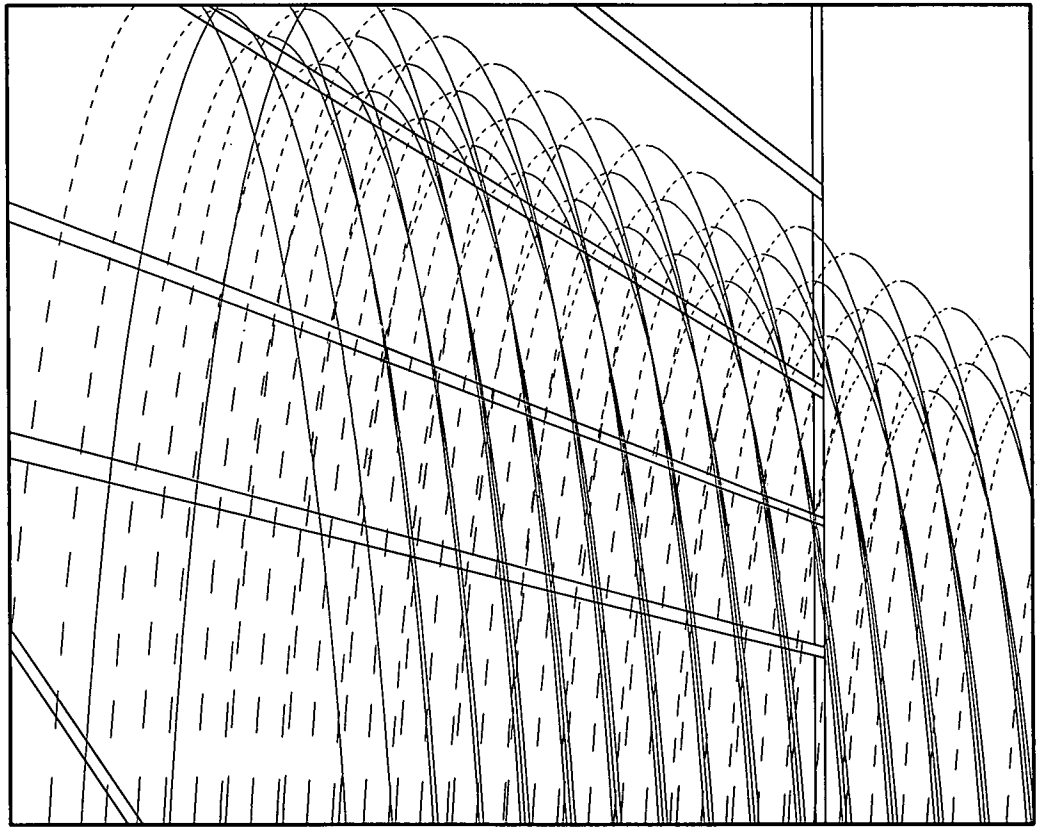
Figure 15:
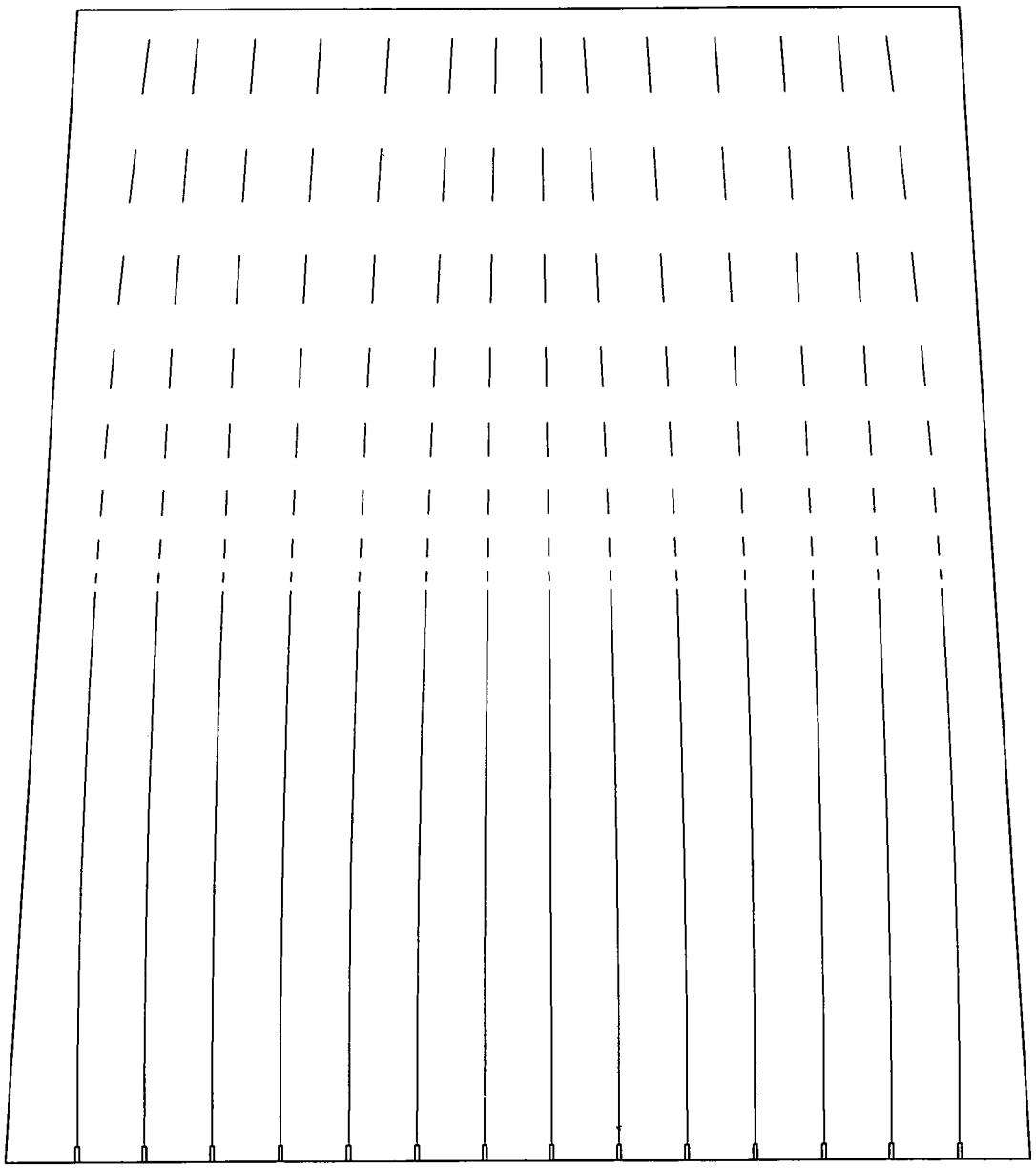

Additional vertical beams 110, horizontal beams 112, diagonal beams 114 and other types of beams or components may be configured with support structure 108 and water wall 102 to provide additional stability to support structure 108 and water wall 102 as necessary. For example, as shown in FIG. 11, beams 110, 112, 114 may be joined together by joints 115, which may include a housing and receptacles to receive such beams.

In general, support structure 108 is preferably designed to adequately support water wall 102 while withstanding the pressure of water shot onto water wall 102, any added weight of this water on water wall 102, as well as any other forces that may impinge upon water wall 102 including forces of nature such as gravity, wind, rain, snow or other forces.

One skilled in the art will appreciate that other types of support structures with other elements and components may be configured with water wall 102 to supply the necessary support and stability to water wall 102. In any event, in certain applications of display 10, it is preferred that support structure 108 be relatively minimal in physical appearance to avoid obstructing the visual effects provided by display 10. To this end, the number and size of beams may be reduced as long as sufficient support is provided, and the beams may be configured in the interior areas of water wall 102 so that they do not distract viewers and diminish the aesthetics of water display 10. As an alternative, the industrial look that may be provided by support structure 108 may actually enhance the overall appearance of display 10 in certain applications.

Water delivery assembly 200 is now further described with reference to FIG. 2. While a primary embodiment described below relates to manifolds, other types of water delivery devices may be used. Water delivery assembly 200 may include water manifold 202 that may be positioned generally in front of and parallel to water wall 102. In one embodiment, water manifold 202 may comprise a pipe or other tubular structure, and may be positioned in front of water wall 102. In one embodiment, manifold 202 may be spaced several feet in front of water wall 102, but other distances may be used.

Figure 2:
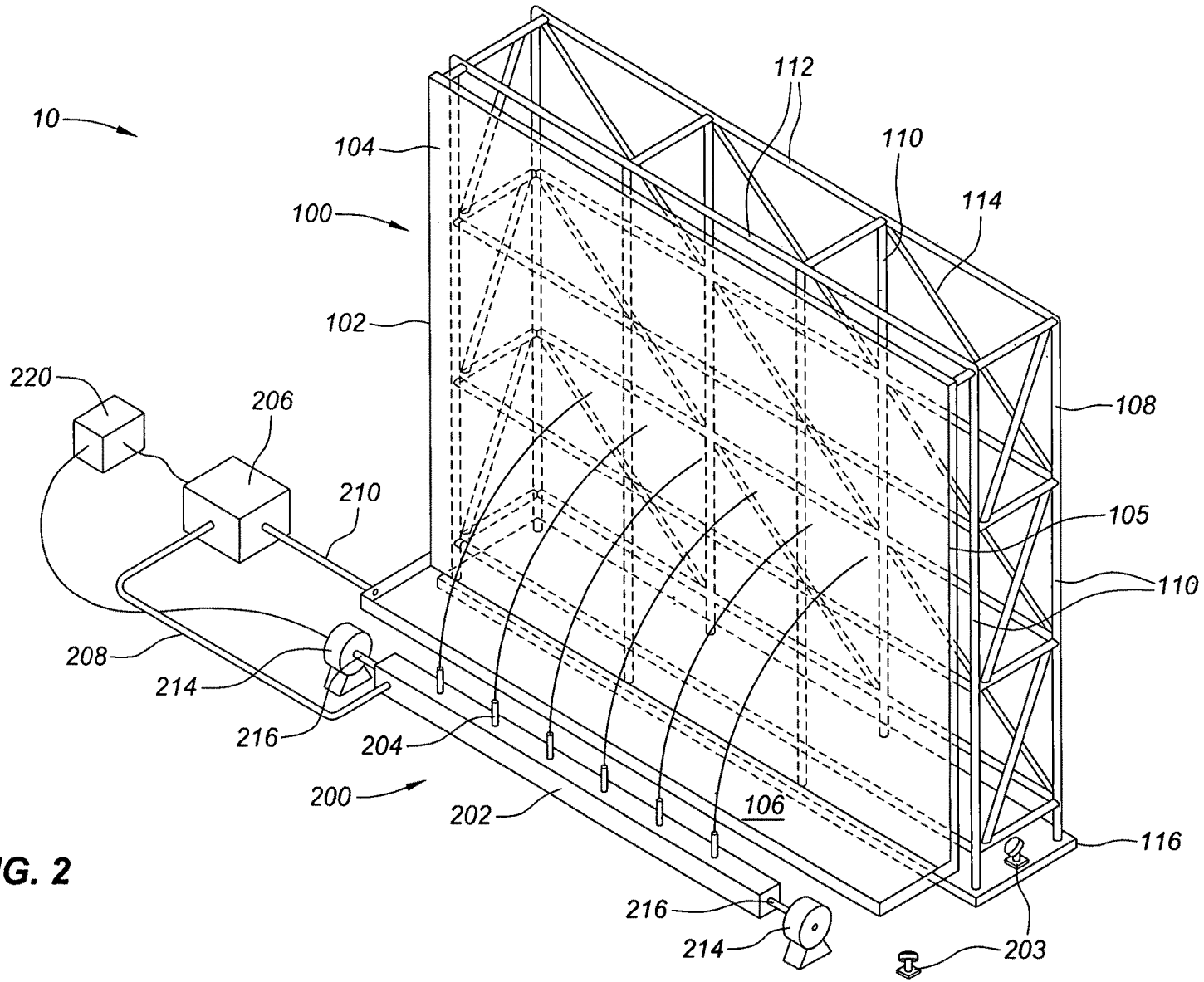
FIG. 2 is a perspective view of a water display including a wall and water nozzles.

In FIG. 2, water manifold pipe 202 is depicted as having a generally square cross section, but other cross sectional shapes, e.g., circular, may be used. Water manifold pipe 202 may receive water from water supply 206 through water supply pipe 208. Manifold 202 may include water nozzles or jets 204 that may be spaced apart from each other along the length of manifold pipe 202. Water nozzles 204 generally receive water from manifold pipe 202 and direct or shoot it toward front surface 104 of water wall 102. While FIG. 2 shows six water nozzles or jets 204, other numbers of water nozzles may be used.

In addition, water supply 206 is depicted as a water tank in FIG. 2, however, other suitable types of water supplies such as pools, troughs, reservoirs or other types of water supplies may be used. Water from water supply 206 may be delivered to water manifold pipe 202 through water supply pipe 208 at a sufficient pressure and volume such that water may shoot out of water nozzles 204 at a pressure and velocity to reach and adequately impinge upon front surface 104 of water wall 102. While FIG. 2 depicts one water supply pipe 208, multiple water supply pipes 208 may be used.

The direction at which water may be shot out of water nozzles 204 is now further described with reference to FIGS. 3A and 3B. In general, the angle of water nozzles 204 relative to water wall 102 may be varied by rotating manifold 202. Alternatively, the direction of water nozzles 204 may be individually controlled as described later.

Figure 3A:
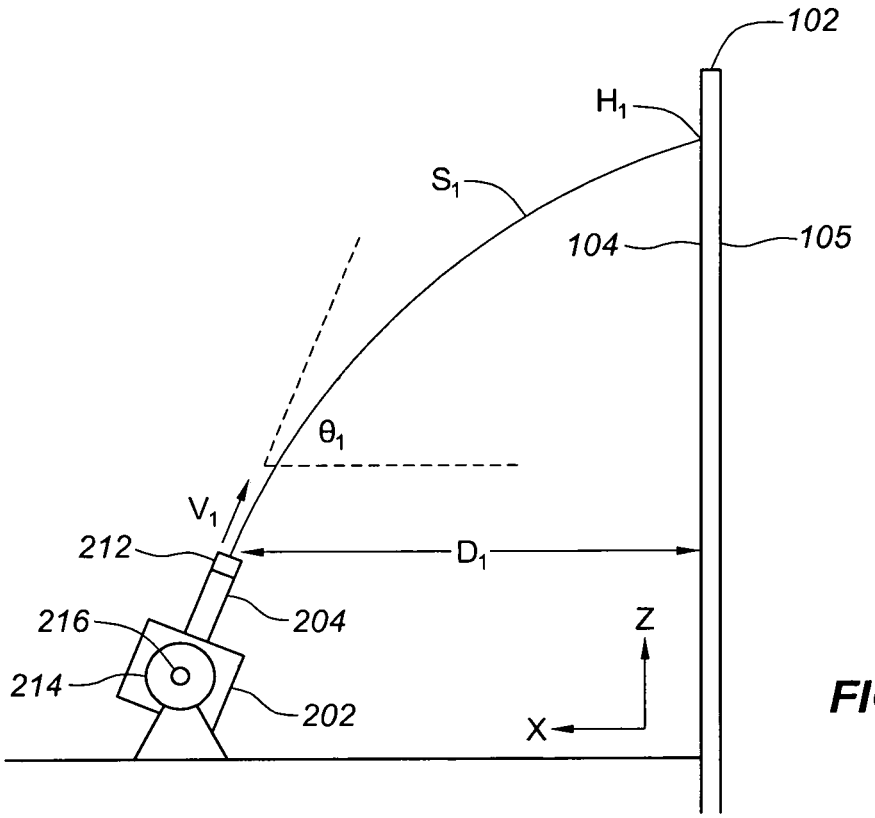
FIG. 3A is a side view of a water display showing water being shot at a wall at an angle.
Figure 3B:
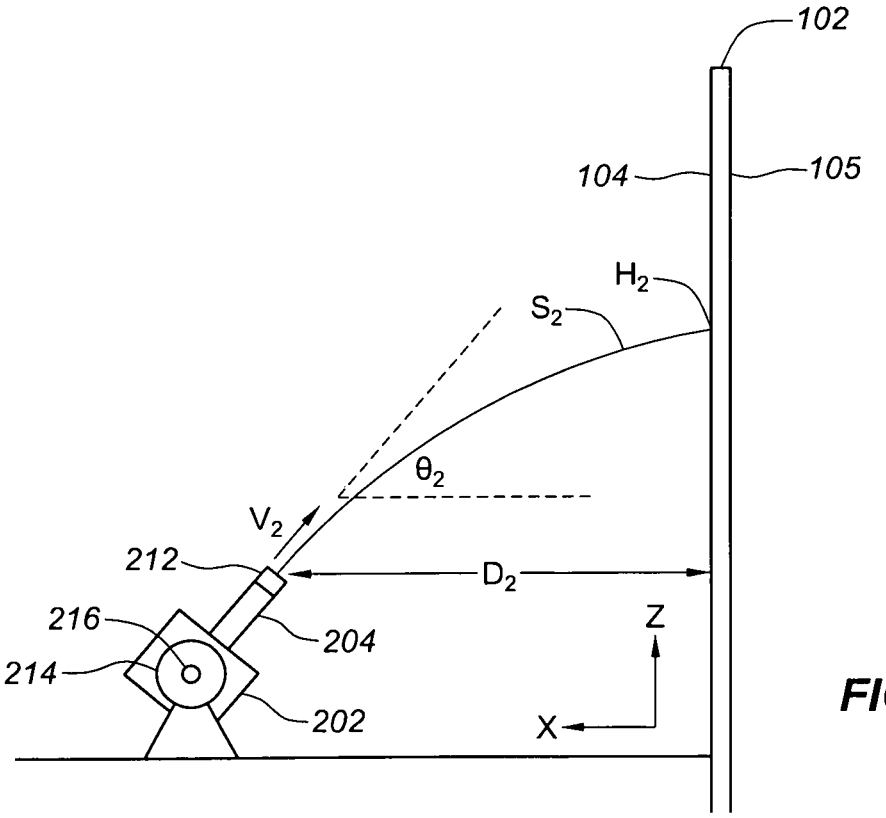
FIG. 3B is a side view of a water display showing water being shot at a wall at another angle.

As depicted in FIGS. 3A and 3B, water shot out of water nozzles or jets 204 may intersect front surface 104 of water wall 104 at a particular point dependent upon the launch angle of the water, the exit velocity of the water as it leaves water nozzles 204, and the distance between nozzle 204 and front surface 104. In addition, the trajectory of a water stream shot from a nozzle or jet may be generally parabolic, not taking into account air drag, the possible dispersion of the water stream during the trajectory and other factors.

As an alternative to parabolic trajectories, the directions of water nozzles or jets 204 may be varied to provide non-parabolic streams such as those described in U.S. patent application Ser. No. 14/214,514, which is hereby incorporated by reference as if fully set forth herein.

Referring again to FIG. 3A, water stream $S_1$ may be shot from nozzle 204 at a launch angle $\theta_1$, with an exit velocity $V_1$ and at a distance $D_1$ from water wall 102, so that stream $S_1$ intersects front surface 104 at a height $H_1$. In FIG. 3B, water stream $S_2$ may be shot from nozzle 204 at a launch angle $\theta_2$, with an exit velocity $V_2$ and at a distance $D_2$ from water wall 102, so that stream $S_2$ intersects front surface 104 at a height $H_2$. As such, by varying the values of the launch angle, the exit velocity and the distance between nozzles 204 and front surface 104, the height at which a water stream shot intersects front surface 104 may be controlled. This preferably provides visual effects that may be varied by changing the foregoing parameters.

As shown in FIGS. 3A and 3B, the launch angle of the water streams may be varied by adjusting the angle of manifold 202. In addition, the water pressure and flow rate of water introduced to manifold 202 and into nozzles 204 may also be varied to control the exit velocity of the water streams as they emanate from nozzles 204. Therefore, by controlling both the launch angle and the exit velocities of the water streams, and by keeping the distance between water nozzles 204 and front surface 104 constant, the height position upon which the water streams contact front surface 104 may be controlled to provide the desired visual effect.

The manner in which the water streams emanating from manifold 202 may be controlled is now further described. As noted above, the angle of nozzles or jets 204 may be varied by rotating manifold 202. The rotation of manifold 202 may be programmable, such as by programmable control by controller 220 (in FIG. 2).

Furthermore, the exit velocity of the water streams emanating from nozzles 204 may also be varied, programmable or otherwise, by varying the water flow and/or pressure into nozzles 204. Water flow and pressure may be controlled by controller 220. And the variation in water flow and pressure may be effected by, e.g., varying the rotational speed of a pump via a variable frequency drive, where the pump may be located in water source 206. Alternatively, water source 206 may include other types of flow control, such as variable or programmable valves, which may be located in water source 206. It should be noted that the above-mentioned pump, valves or other device for controlling water flow and pressure into nozzles 204 may be located at locations other than water source 206.

Figure 3C:
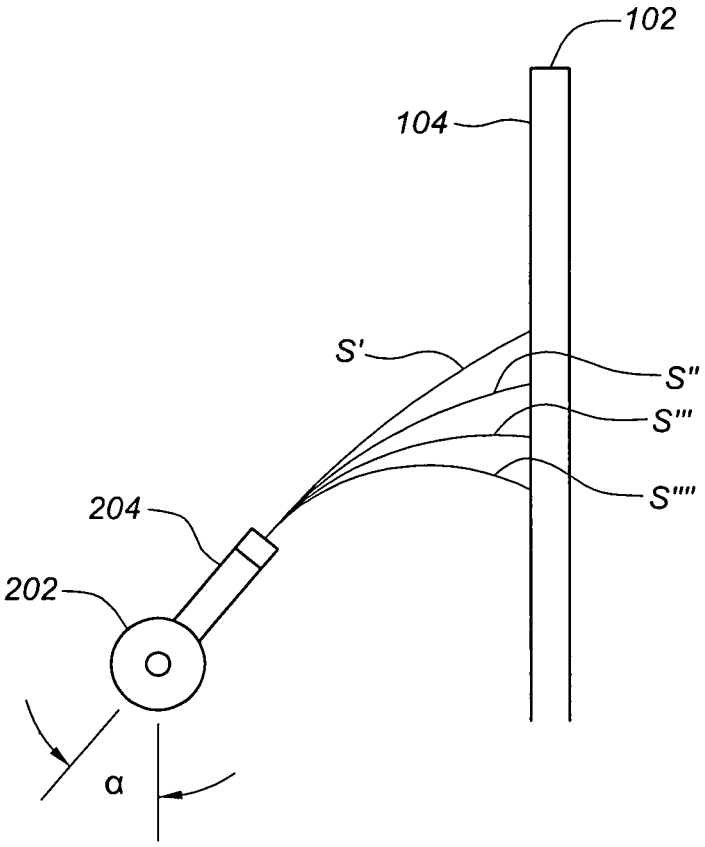
FIG. 3C is a side view of a water display showing water shot at a constant angle but at different exit velocities.

Though the nozzle angle and exit velocity variables are both variable, different visual effects may be achieved by changing one variable while keeping the other variable constant. For example, as shown in FIG. 3C, while nozzle angle $\alpha$ is held constant, varying the water exit velocity may produce any of water Streams S', S'', S''', S'''', where S' represents a higher exit velocity, and S'''' represents a lower exit velocity.

By combining the variable (i) nozzle angle and (ii) water exit velocity, many different artistic and visual effects may be achieved. These effects may be enhanced by choreographing the angle, height and volume of the water streams simultaneously. These effects may be further enhanced by choreographing them with lighting, music and/or other sensory effects.

It should be noted that the exit velocity of the water shot from nozzles 204 may also depend on the dimensions of the exit orifice of nozzles 204 and the water pressure at the exit orifice. To control these parameters, nozzles 204 may include jets 212, as depicted in FIG. 3A and FIG. 3B, which have exit orifice dimensions to provide the desired streams. Jets 212 thereby add another degree of control over the visual effects provided by display 10.

To provide the adjustability of the water streams, the ends of manifold 202 may be attached to rotating mounts 214 as depicted in FIGS. 2, 3A, 3B and 3C. Mounts 214 may include rotating axles 216 that may controllably rotate clockwise and counter clockwise and that may be configured to hold and rotate manifold 202. Alternatively, the mount which provides rotation may be located along the length of manifold 202 between its ends. In any event, rotating mounts 214 provide rotation, water manifold pipe 202, and therefore water nozzles 104 attached thereto, may be caused to rotate to vary the visual effect of the water impinging upon water wall 102 as discussed above.

For example, rotating axles 216 may be set to an angle of $\theta_1$ so that the resulting water stream $S_1$ may intersect front surface 104 at intersect height $H_1$. Rotating axles 216 may then be adjusted clockwise to an angle of $\theta_2$ so that the resulting water stream $S_2$ may intersect front surface 104 at intersect height $H_2$. It should be noted that as rotating axle 216 is rotated clockwise from an angle of $\theta_1$ to an angle of $\theta_2$, the water emitted from nozzles 204 may flow continuously such that the intersection point of the water stream with front surface 104 may travel continuously from $H_1$ to $H_2$ as the water stream travels downward.

With the foregoing embodiment, the direction of the water streams and the location and manner in which they contact water wall 102 may be varied so that they are choreographed with music, lighting and other visual or audio effects. For example, the water streams may be directed higher to correspond to a crescendo in accompanying music or intensity in lighting. Various other choreographies may be achieved by display 10.

It is preferred that the rotation of water manifold pipe 202 and nozzles 204 is unobstructed. In one embodiment, water delivery assembly 200 may be located under ground or under a cover so that its hardware is generally obscured from view. In this embodiment, slots in the floor or other cover may exist to accommodate the travel of nozzles 204 as their direction is varied.

The angle setting of rotating axles 216 may be manually adjusted by use of a knob, handle, wheel, or other suitable adjustment mechanisms, or may be controlled by a controller 220, such as a computer, or other type of controller 220 with or without the use of specialized software. This is further described below. In any event, the manual or computer control of manifold 202 and nozzles 204 may be choreographed to correspond to other audio and/or lighting features.

The manner in which nozzles 204 may be configured with manifold 202 is now further described. In the above embodiments, nozzles 204 are fixed to manifold 202 so that they rotate together. In one embodiment, nozzles 204 may be aligned along the length of water manifold pipe 202, spaced evenly from one another, and may be pointed at the same general upward angle. In this manner, the streams emitted by nozzles 204 may generally have the same trajectories.

Figure 4:
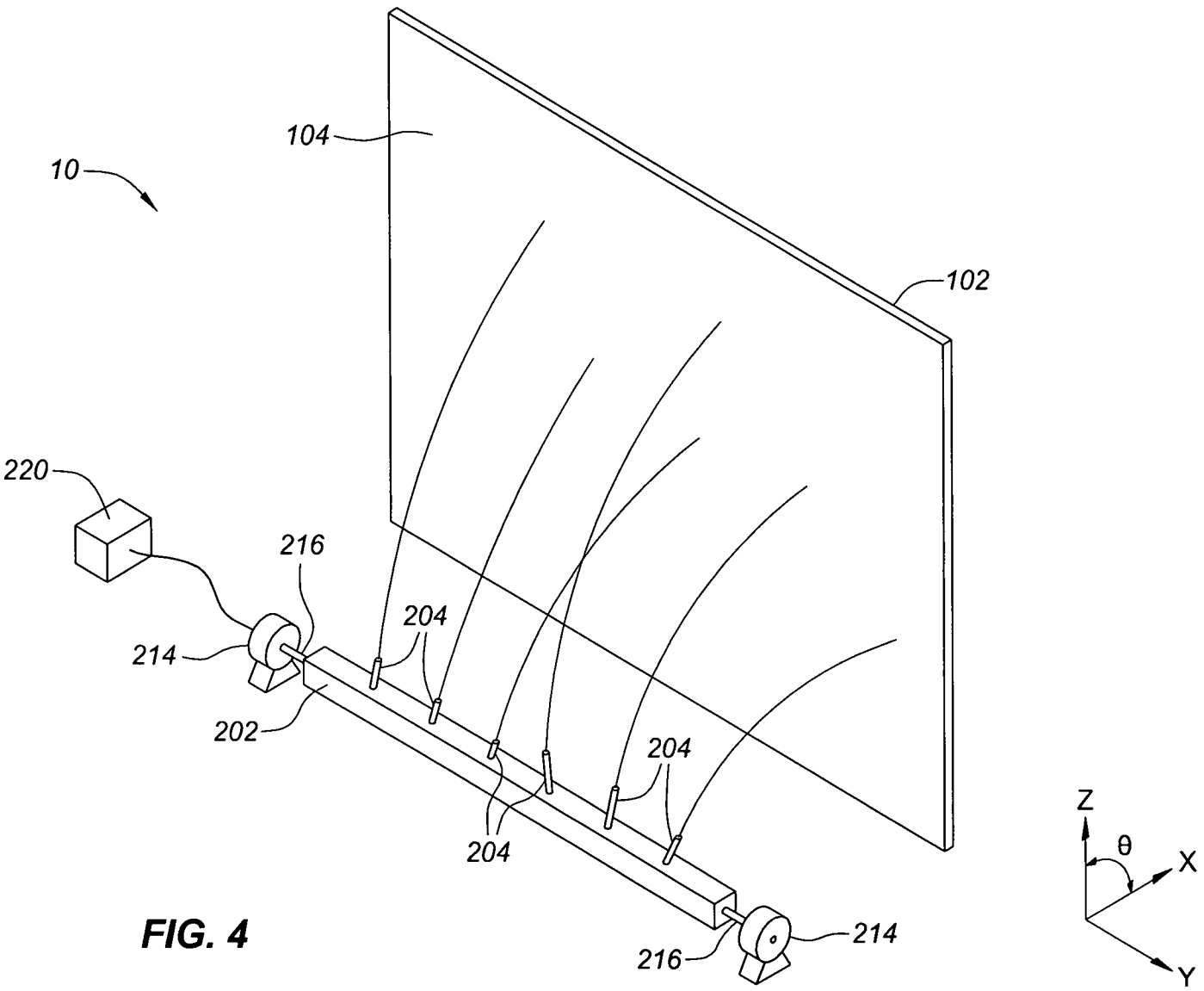
FIG. 4 is a perspective view of a water display including a wall and water nozzles, wherein the direction of the water nozzles is varied along a manifold.

Alternatively, the spacing of nozzles 204 and their directions may vary. For example, as shown in FIG. 4, nozzles 204 may be attached to manifold 202 in a spiral configuration so that each nozzle 204 may direct water in a different direction relative to one another for a given angular position of manifold 202. In this manner, each nozzle 204 may direct water streams at water wall 102 at different launch angles. This allows the water streams to form different patterns of water that hits front surface 104 thus creating entertaining visual effects. As shown, nozzles 204 may be configured so that the water streams may intersect each other.

FIG. 4 depicts nozzles 204 having different angular positions of angle θ compared to each other generally along the x-z plane. However, the angles of nozzles 204 may also vary from one another along the y-z plane (not shown) or x-y plane (not shown). In addition, it can be seen that the angles of nozzles 204 may also vary from one another along any possible geometrical plane, or any possible combinations of geometrical planes. In the foregoing examples, nozzles 204 are generally fixed to manifold 202. In another embodiment, however, nozzles 204 may be attached to manifold 202 so that their directions may be controllable varied relative to manifold 204, thereby providing more degrees of variability in the visual effects provided by display 10.

As described above, the water pressure and flow rate within manifold 202 and nozzles 204 may be controlled to vary the water streams' nozzle exit velocity, as well as the intersection points of the water streams upon front surface 104. For example, the water pressure of water released by water supply 206 into water supply pipe 208 may be controlled to vary these parameters. In addition, valves (not shown) within water supply 206, water manifold pipe 202 or nozzles 204 may be utilized to adjust the water pressure within these components. Furthermore, jets 212 may also include valves (not shown) or adjustable exit orifices that may control the water pressure and thus the exit velocity of the water streams as they are emitted by nozzles 204. Other types of mechanisms or components may be used within water delivery assembly 200 to control and adjust the water pressure within its components. The control of water pressure and flow rate may occur manually or by computer control, as described later.

Referring back to FIGS. 3A and 3B, the distance D between manifold 202 and front surface 104 may also affect the intersection point and height between the streams and front surface 104. As shown, a smaller distance D results in a lower trajectory and intersection height when compared to a larger distance D. To provide another degree of control, the distance D between manifold pipe 202 and front surface 104 may also be variably controlled. To provide such control, manifold pipe 202 may be mounted on tracks (not shown) or other mechanisms to vary the location of manifold 202 relative to water wall 202.

FIGS. 3A and 3B show movement of manifold 202 along the x-axis, the location of manifold 202 may be varied in other directions. In addition, manifold 202 may move side-to-side along the y-axis (the y-axis is shown in FIG. 4), up and down along the z-axis, or in any direction along any geometrical axis or in any combination of geometrical axis. This may be accomplished by the use of tracks, wheels or other movement mechanisms.

One or more of the foregoing parameters may be simultaneously adjusted to vary the launch angle θ, the water pressure and exit velocity of the water streams, and the position of nozzles 204 relative to front surface 104. By adjustably controlling one or more these parameters simultaneously the trajectories of the water streams and their intersection points along front surface 104 may be adjusted in a variety of dimensions in real time to provide a dynamic and entertaining water display experience. These parameters may be controlled simultaneously by a controller 220 such as a PC or other type of controller 220 with or without the use of specialized software. This is described in further detail below.

In addition to the adjustment of the variables described above, jets 212 may also be configured with nozzles 204 to have the ability to physically alter the water streams as the streams are emitted therefrom. For example, jets 212 may have the ability to increase the size of their water exit orifices to allow a higher volumetric flow of water to be shot from nozzles 204 upon front surface 104 of water wall 102. Likewise, jets 212 may have the ability to decrease the size of their exit orifices to create a lower volumetric flow of water to be shot from nozzles 204 upon front surface 104 of water wall 102. These dimensional adjustments of the exit orifices of jets 212 may be adjusted manually or through a controller 220 or by other means. Launching higher and lower volumetric flows of water from nozzles 204 may result in a different appearance of the water as it intersects front surface 104 of water wall 102 thus providing yet another variable aspect of water display 10.

Nozzles 204 may include jets 212 that may physically adjust the water streams into different types of shapes and water blooms. For example, jets 212 may alter the emitted water stream into a laminar stream. Or, jet 212 may alter the emitted water stream into a fan-shaped stream, into a bloom-shaped stream, into a bell-shaped stream or into other shaped streams. In addition, jets 212 may have the ability to quickly open and close in order to release bursts of water streams from nozzles 204. In sum, nozzles 204 and jets 212 may be configured to emit a wide variety of types and shapes of water streams to intersect with front surface 104.

Figure 5:
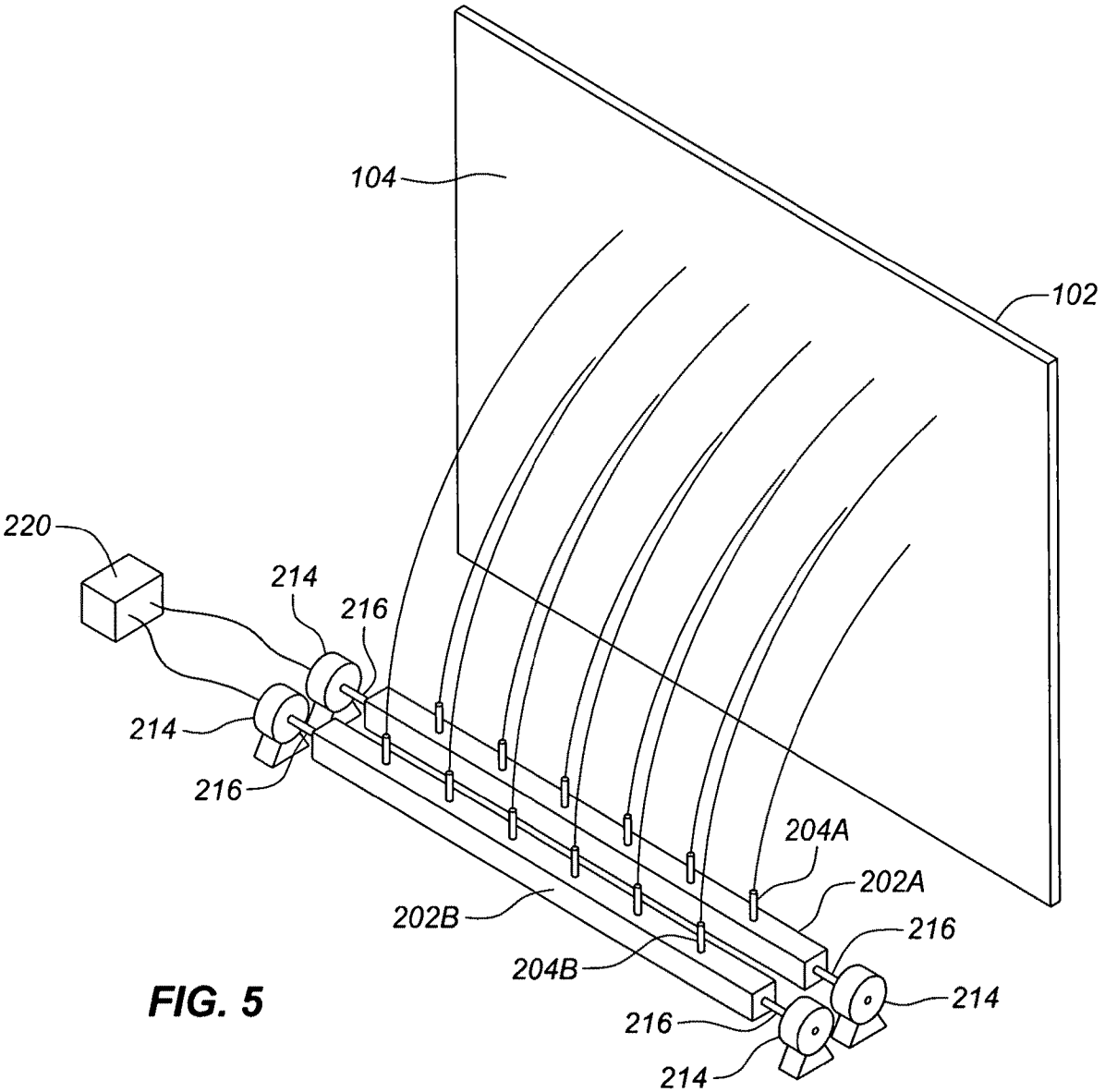
FIG. 5 is a perspective view of a water display including a wall and two rows of water nozzles.

In another embodiment of the current invention as shown in FIG. 5, water delivery assembly 200 may include a second manifold 202 that may be generally located in front or behind the first manifold 202. In this embodiment, the angular position of each water manifold pipe 202 may be independent of one another and may be configured with their own independent rotating mounts 214 and rotating axles 216 (or other rotation device). This allows additional visual effects. For example, manifold 202A may rotate clockwise while manifold 202B rotates counter clockwise, or both water manifold pipes 202A, 202B may rotate in the same direction at similar or different speeds. As will be described in more detail in later sections, the rotation of multiple water manifold pipes 202 may be manually controlled or may be controlled by a controller 220 such as a computer or other controller 220 such that the movements of each water manifold pipe 202 may be synchronized with each other, and choreographed with music, lighting or other features.

As also shown in FIG. 5, the position of nozzles 204 along their respective manifolds 202A, 202B may be offset relative to each other so that the water steams emitted by nozzles 204A do not obstruct or collide with water streams 204B. Alternatively, nozzles 204A, 204B may be spaced or directed so that their streams intersect or provide other visual effects. Additionally, any number of manifolds 202 configured with nozzles 204 may be used in conjunction with water wall 102 to provide additional visual effects by display 10.

Figure 6:
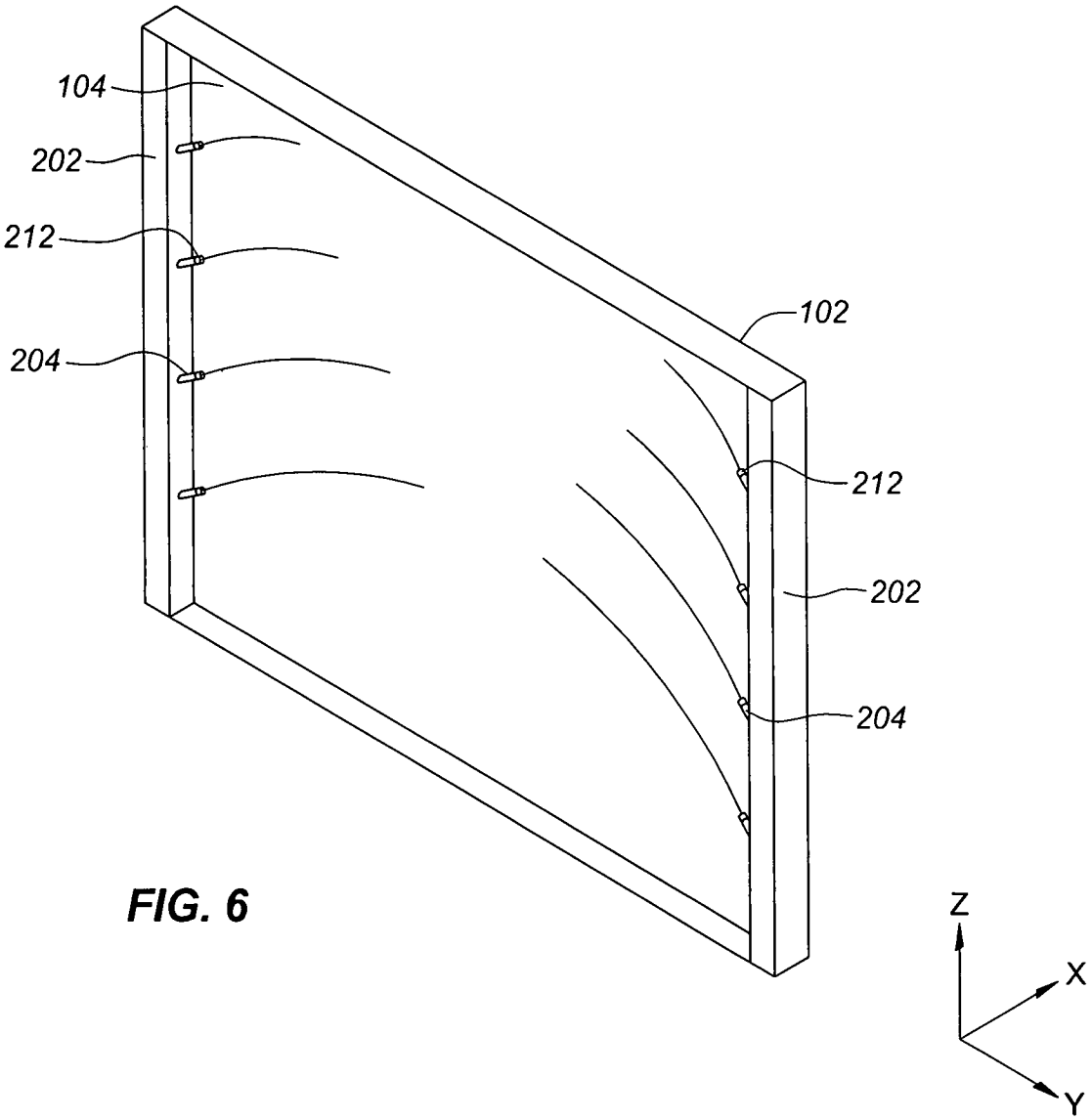
FIG. 6 is a perspective view of a water display including a wall and water nozzles configured with the wall.
Figure 7:
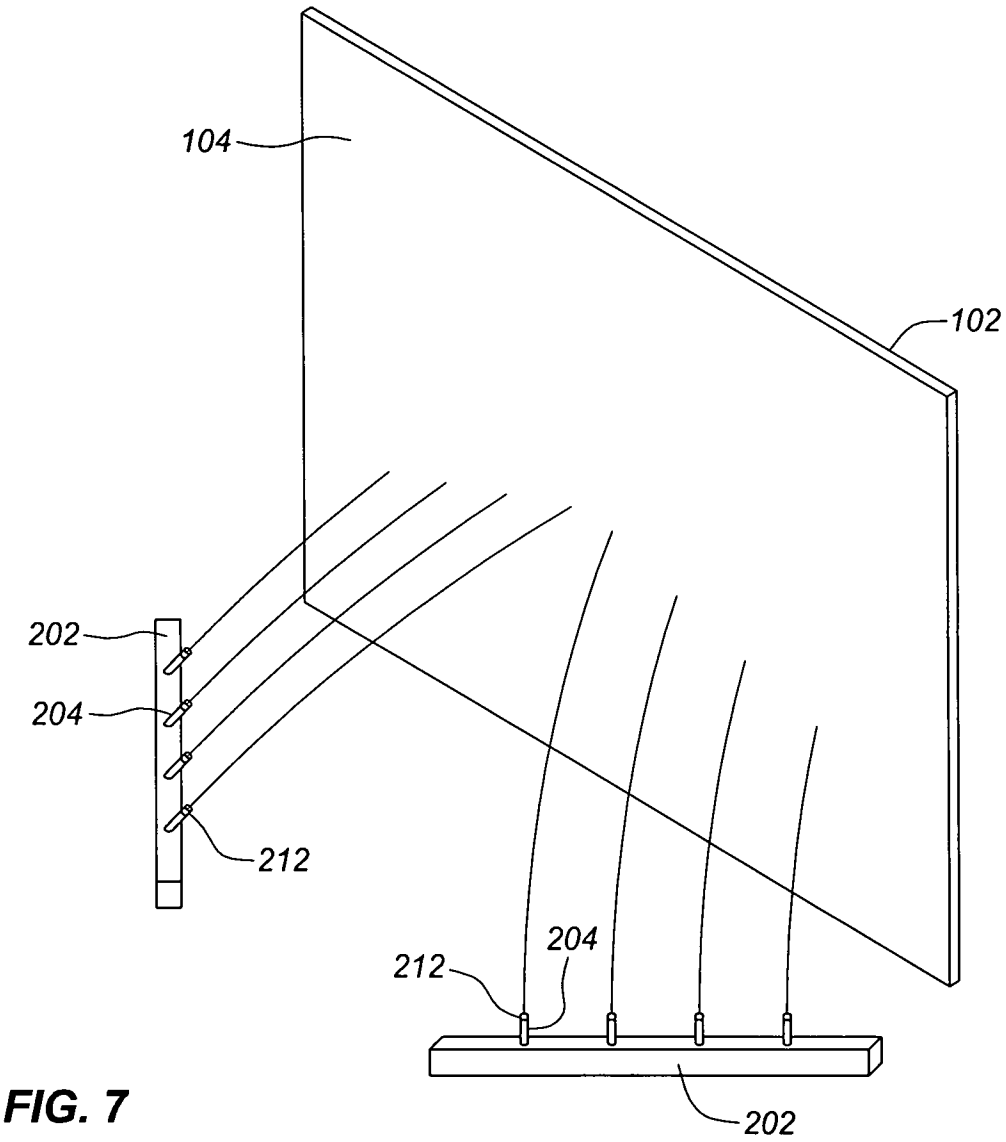
FIG. 7 is a perspective view of a water display including a wall and two sets of water nozzles.

The positioning of water delivery assemblies 200 may further varied with respect to water wall 102. For example, manifolds 202, nozzles 204 and jets 212 may be located on the left and right sides of water wall 102 as shown in FIG. 6. In this embodiment, manifolds 202 may be generally upright and aligned with water wall 102 such that water streams shot by nozzles 204 may generally emit from the sides of water wall 102. In addition, manifolds 202, nozzles 204 and jets 212 may be generally located along the top edge of water wall 102 (not shown) such that water streams are emitted downward. In any event, water delivery assemblies may be positioned along any sides, edges or other elements of water wall 102, or with any combination of sides, edges or other elements of water wall 102. In another embodiment shown in FIG. 7, manifolds 202, nozzles 204 and jets 212 may be located on the ground and at an angle to water wall 102.

From the foregoing, one skilled in the art will appreciate that manifolds 202, nozzles 204 and jets 212 may be located in a wide variety of positions relative to water wall 102. In another embodiment, water may be shot from flying drones that may fly near water wall 102.

In these additional embodiments, as in the embodiments discussed previously, the control of the direction of the water steams, their nozzle exit velocity, the distance between nozzles 204 and front surface 104, and other variables that may affect the trajectory of the water streams emitted by nozzles 204 may also be manually or automatically controlled.

Figure 8:
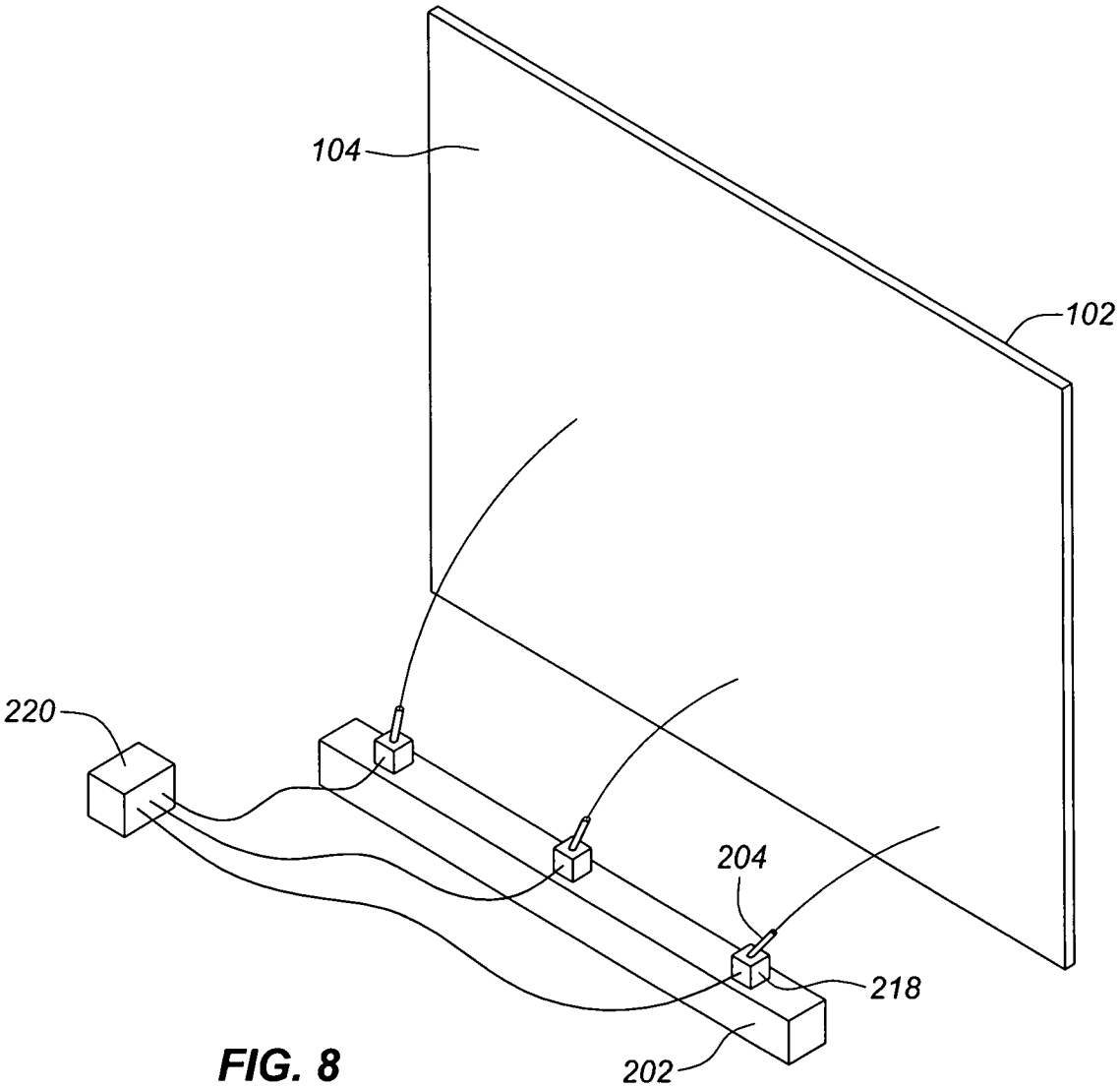
FIG. 8 is a perspective view of a water display including a wall and water nozzles coupled to a manifold where the direction of the nozzles may be individually controlled.

In another embodiment as shown in FIG. 8, nozzles 204 may individually articulate with respect to each other. That is, the angular position of each nozzle 204 may each be adjusted in one or more of three dimensions (x, y and z) independently of each other. This may allow nozzles 204 configured with water manifold pipe 202 to be angularly adjusted in real time such that each nozzle 204 may shoot water streams at angular different trajectories. In this embodiment, each nozzle 204 may be mounted on an angular mount 218, for example, a ball mount, which may allow for nozzles 204 to move and be adjusted to any angle in one or more of three dimensions. Each angular mount 218 may have manual adjustment controls (not shown) for manual adjustment of each nozzle 204 for a given performance by display 10. Alternatively, angular mounts 218 may be motorized and may be controllable or otherwise programmable for automatic adjustment before and/or during a performance.

With this embodiment, manifold 202 need not rotate to vary the visual effects of display 10, so components such as rotating mounts 214 may be unnecessary. Alternatively, manifold 202 may still rotate in order to add another element of variability to the control and adjustment of the resulting water streams.

Figure 9:
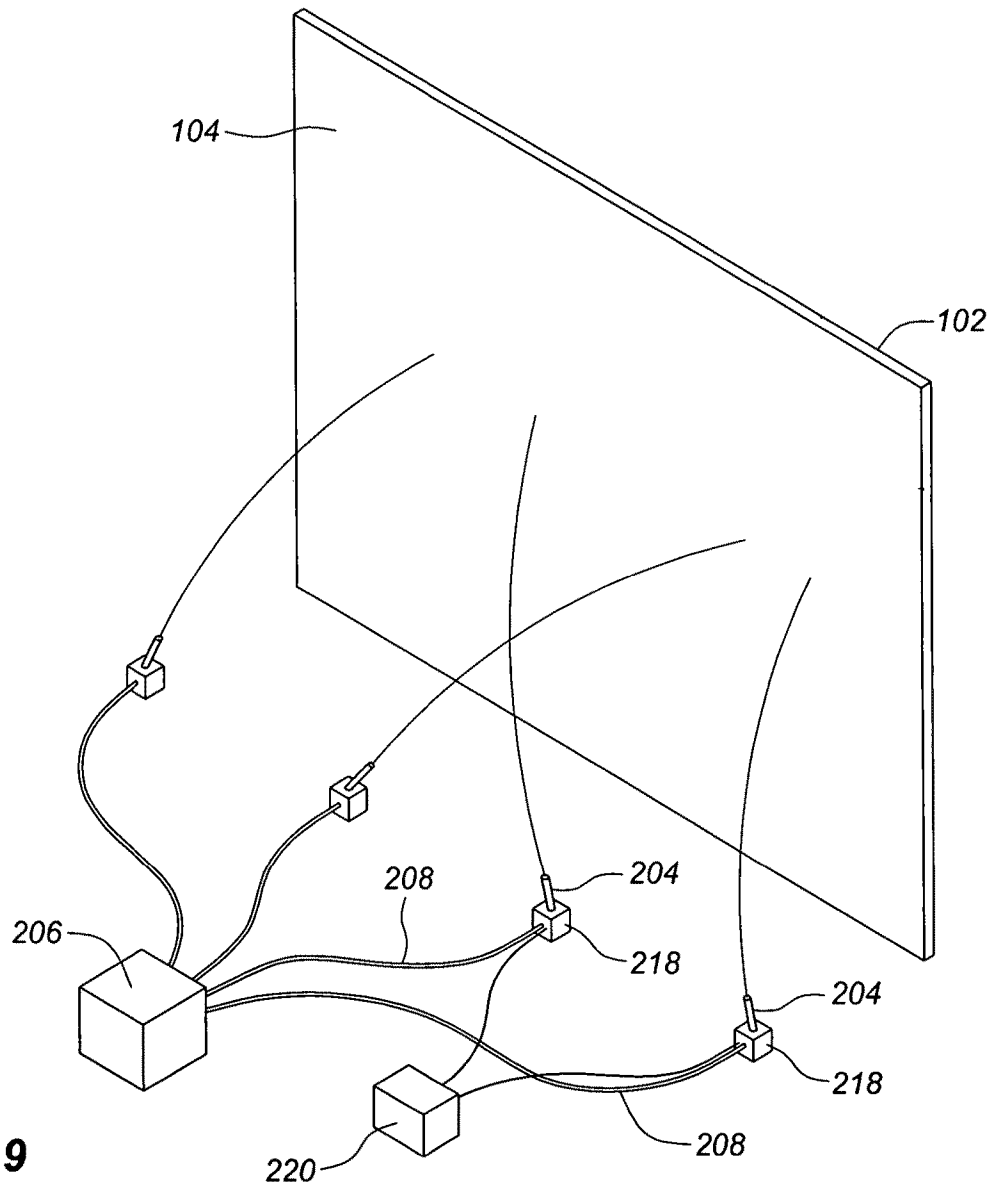
FIG. 9 is a perspective view of a water display including a wall and individual water nozzles.

In another embodiment as shown in FIG. 9, nozzles 204 may be configured individually without a manifold. As seen, nozzles 204 may each be mounted on angular mounts 218 such that each nozzle 204 may be angularly adjusted one or more dimensions (x, y and z) independently of each other. Each nozzle 204 may also each include water supply pipes 208 to receive water from water supply 206.

As with other embodiments discussed above, nozzles 204 mounted on angular mounts 218 may be positioned in any location on or around water wall 102 so that water shot from nozzles 204 may interact with water wall 102 in any number of manners. Individual nozzles 204 may also be mounted on tracks or other mechanisms that may allow their positions to be moved relative to water wall 102. Each independent nozzle 204 and angular mount 218 may be manually adjusted or adjusted under computer or other automatic control.

Figure 10:
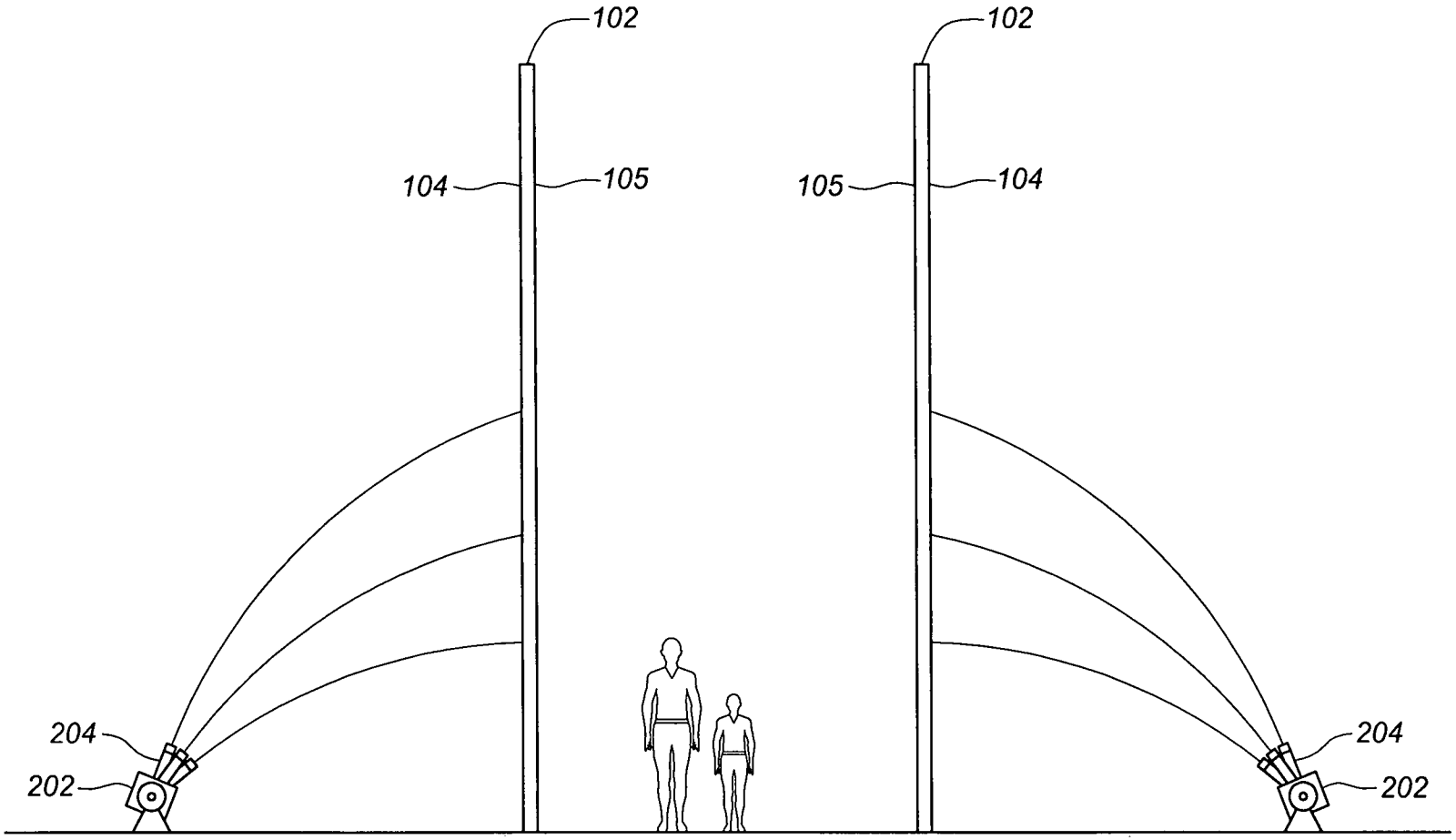
FIG. 10 is a side view of a water display including two walls forming a tunnel and two sets of water nozzles, and wherein observers may walk through the tunnel.

Additional embodiments of display 10, such as that shown in FIG. 10, are now described. In this embodiment, display 10 may include two water walls 102 spaced apart so as to form a walkway for observers. As shown, front surfaces 104 of water walls 102 may be located opposite to where the observers view display 10, and rear surfaces 105 of each water wall 102 may face the observers. Nozzles 204 in FIG. 10 are depicted as being configured with water manifold pipes 202, and the angular orientation of nozzles 204 are shown to be at different angles. It should be noted that all of the descriptions of the embodiments described above may be used with the embodiment of FIG. 10.

As such, dramatic visual and entertainment effects may be provided to observers as they walk through display 10. For example, this embodiment may provide the sensation of water being shot at the observers while they themselves remain dry. Alternatively, some amount of water may be directed over the tops of water walls 102 so that a slight or some other amount of water does reach observers.

While FIG. 10 depicts the use of two water walls 102, display 10 may use other numbers of water walls 102 in similar or different configurations. In addition, a roof or top wall may be fitted to the tops of water walls 102 to provide more of a tunnel and/or three-dimensional effect. In this example, water walls 102 that may form the top of the tunnel may be generally flat, rounded, angled or in another type of configuration that may adequately form the top of the tunnel. In this example, additional water nozzles may be directed downward at the top.

In another example, water walls 102 may be configured to form a maze through which observers may pass. In this embodiment, water walls 102 may be configured generally upright at different angles relative to one another. Music, lighting and/or other effects may be added for additional enhancement.

Regarding any of the foregoing embodiments, water walls 102 need not be generally upright, but may be configured in different angles with respect to the ground. For instance, water walls 102 may be slanted such that observers may pass underneath the slanted arc of water wall 102. It should also be noted that water walls 102 need not be generally rectangular in shape, but may be configured in other types of shapes such as triangles, circles, trapezoids and other types of shapes. In addition, water walls 102 may be configured to form other types of three dimensional shapes such as pyramids, cones or other types of three dimensional shapes that may or may not allow observers to enter into the interior of the shapes.

While the above embodiments have been described with nozzles 204 shooting water onto front surface 104, nozzles 204 may be configured and positioned to shoot water onto any surface or element of water wall 102, such as rear surface 105. To this end, the descriptions above regarding manifold pipes 202, nozzles 204, jets 212 and other components in relation to shooting water onto front surface 104, may also apply to nozzles 204 shooting water onto any other surfaces or elements of water wall 102.

In addition, with respect to all of the embodiments described above, water manifold 202 and water nozzles 204 may be hidden and out of sight so that only the emitted water streams may be visible to the viewers of the display 10. For example, when the water manifold 202 and associated water nozzles 204 may be located generally below the water wall 102, the manifold 202 and the nozzles 204 may be located beneath the top surface of a false-bottom pool (not shown) at the base of the wall 102. The top surface of the false-bottom pool may include slits or openings through which the water streams emitted by the water nozzles may pass through while the nozzles themselves are hidden beneath. This may result in a visual effect of the water streams emanating out of the surface of the bottom pool. This same concept may be applied to other configurations where water manifold 202 and water nozzles 204 may be positioned in other areas with regards to water wall 102.

As noted above, display 10 may include one or more lighting assembles to illuminate display 10, such as lighting assemblies 203 shown in FIG. 2. Lighting assemblies may include LED lights of white light or of a variety of colors that may shine onto front surface 104, rear surface 105, or on any other surface or element of water wall 102. The LED lights may also be configured to illuminate the water streams as they are emitted from nozzles 204 and travel to water wall 102. To this effect, the LED lights may mounted on manifolds 202 or nozzles 204 so that the LED lights may be generally aligned with the water streams as they are emitted by nozzles 204 thereby illuminating the water streams as they travel towards water wall 102. In addition, or alternatively, the LED lights may be generally directed to front surface 104 of water wall 104 in order to illuminate intersection of the water streams with front surface 104. As the water streams hit front surface 104 and splash off of front surface 104 or generally adhere and flow down front surface 104, illuminating this interaction of water with front surface 104 may provide enhanced visual effects.

In another embodiment, the lighting assemblies may include fiber optic bundles that may emit different colors of light. In this embodiment, the fiber optic bundles may be configured with nozzles 204 as described above. In addition, if different nozzles 204 utilize fiber optic bundles that may emit different colors, the water streams of different colors emitted by different nozzles 204 may intersect and blend as they hit water wall 102 to create new combinations of color.

In another embodiment, lighting assemblies may be positioned to illuminate front surface 102 from the front, from the rear, or from other areas or positions. In this embodiment, lighting assemblies may illuminate the textures that may exist on front surface 104 of water wall 102. As described above, front surface 104 may include a variety of textures that may form patterns or shapes such as brand logos or the name of the hotel where water display 10 may be installed. By illuminating the textured shapes from different angles, an exciting visual effect may be formed with lighted shapes appearing on water wall 102 behind the water streams as they intersect, splash off and travel down water wall 102. In another embodiment lighting assemblies may be fixed to support structure 108. In another embodiment, flying drones may be equipped with lighting assemblies and may fly around water display 10 while illuminating the water streams, front surface 104 and other elements and components of water display 10.

In general, by lighting water streams and the various surfaces and elements of water wall 102, the finer details of the water streams as they shoot through the air, intersect water wall 102, splash off of water wall 102 or travel down the front surface 104 may be highlighted to further enhance the viewing of water display 10. Examples of lighting applied to display 10 are shown in FIGS. 12-15.

As described above, to add to the dramatic visual effect of water display 10, the trajectory, shape and position of the water streams emitted by water nozzles 204 may be controlled in real time by a controller 220 such as a computer. To accomplish this, the water pressure within water manifold pipe 202 and nozzles 204, the launch angle of the water streams, the distance between nozzles 204 and front surface 104 of water wall 102 and the general position of nozzles 204 relative to water wall 102, the output water stream shape emitted by jets 212 of water nozzles, and other variables may be controlled by controller 220. In addition, the various elements of the lighting assemblies that may be utilized with water display 10, such as color, intensity, position and other elements regarding the use of lighting assemblies in conjunction with water display 10 may also be controlled by controller 220.

Software may reside in controller 220 of water manifold assembly 200 and the lighting assemblies such that both the water manifold assembly 200 and the lighting assemblies may be controlled in real time in an orchestrated fashion. That is, the trajectory, shape and position of the water streams emitted by nozzles 204 at any given moment in time may be adjusted and controlled in parallel with the adjustment and control of the illumination of water display 10. By controlling both the water steam characteristics and the display illumination together in real time in an orchestrated fashion, the result may be a dramatic blend of beautifully illuminated water streams, charging water as it intersects the water wall 102, and cascading ripples down front surface 104.

In addition, software residing within the controller 220 of water manifold assembly 200 and the lighting assemblies may have preprogrammed shows that are automated. Conversely, the software may allow for the manual orchestration of the display 10. In addition, the software may allow for a combination of automated preprogrammed shows that may be manually altered and otherwise manually controlled in real time as desired.

Software may be written to control the characteristics of the water streams and lighting, as well as music, other audio or other media that may be incorporated into the performance of display 10. This may allow for a number of such different programs may be loaded to controller 220 of display 10 to be performed as desired.

Figure 16:
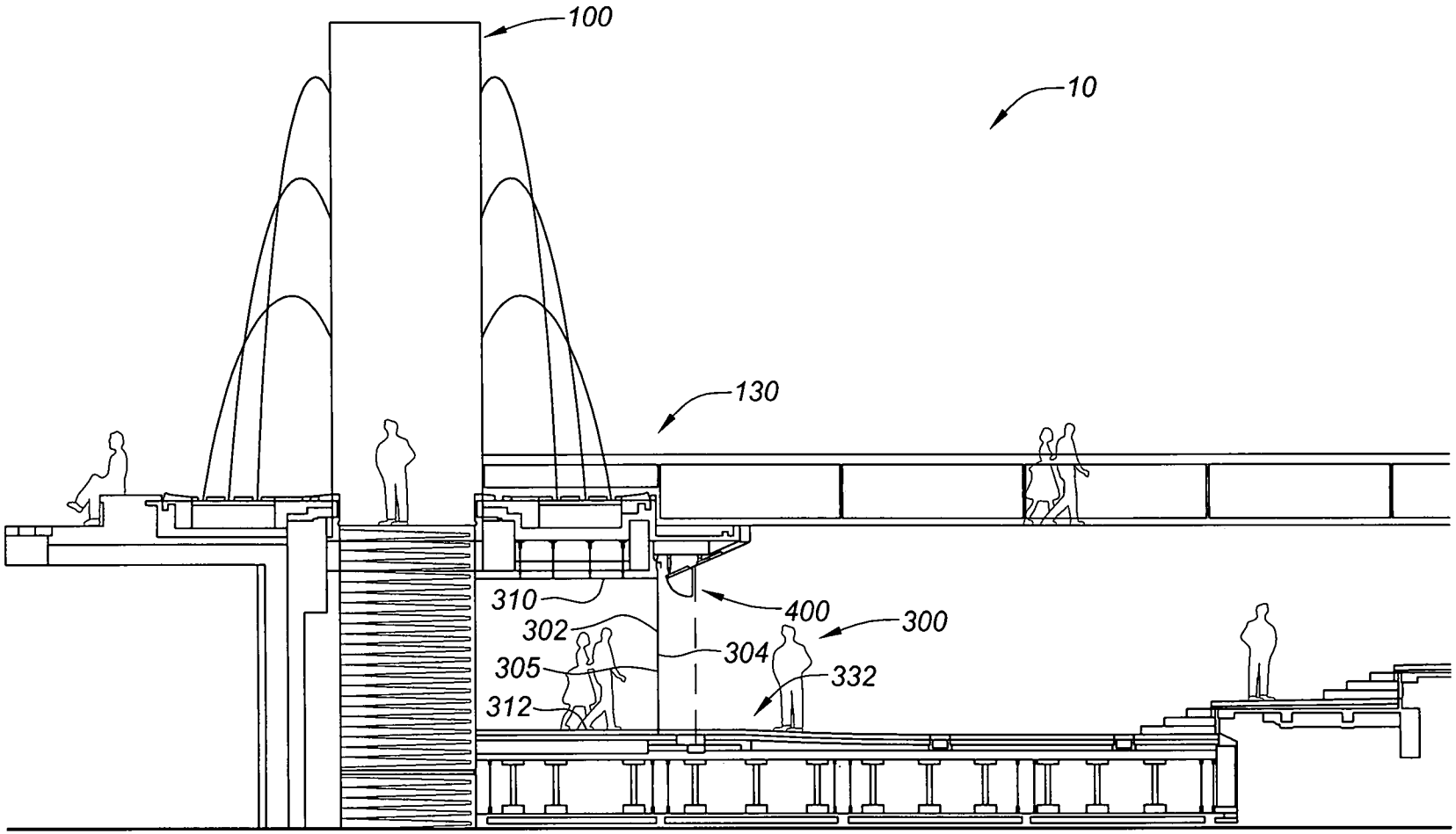
FIG. 16 shows a side view of a water display including an upper water wall and a lower water wall.
Figure 17:
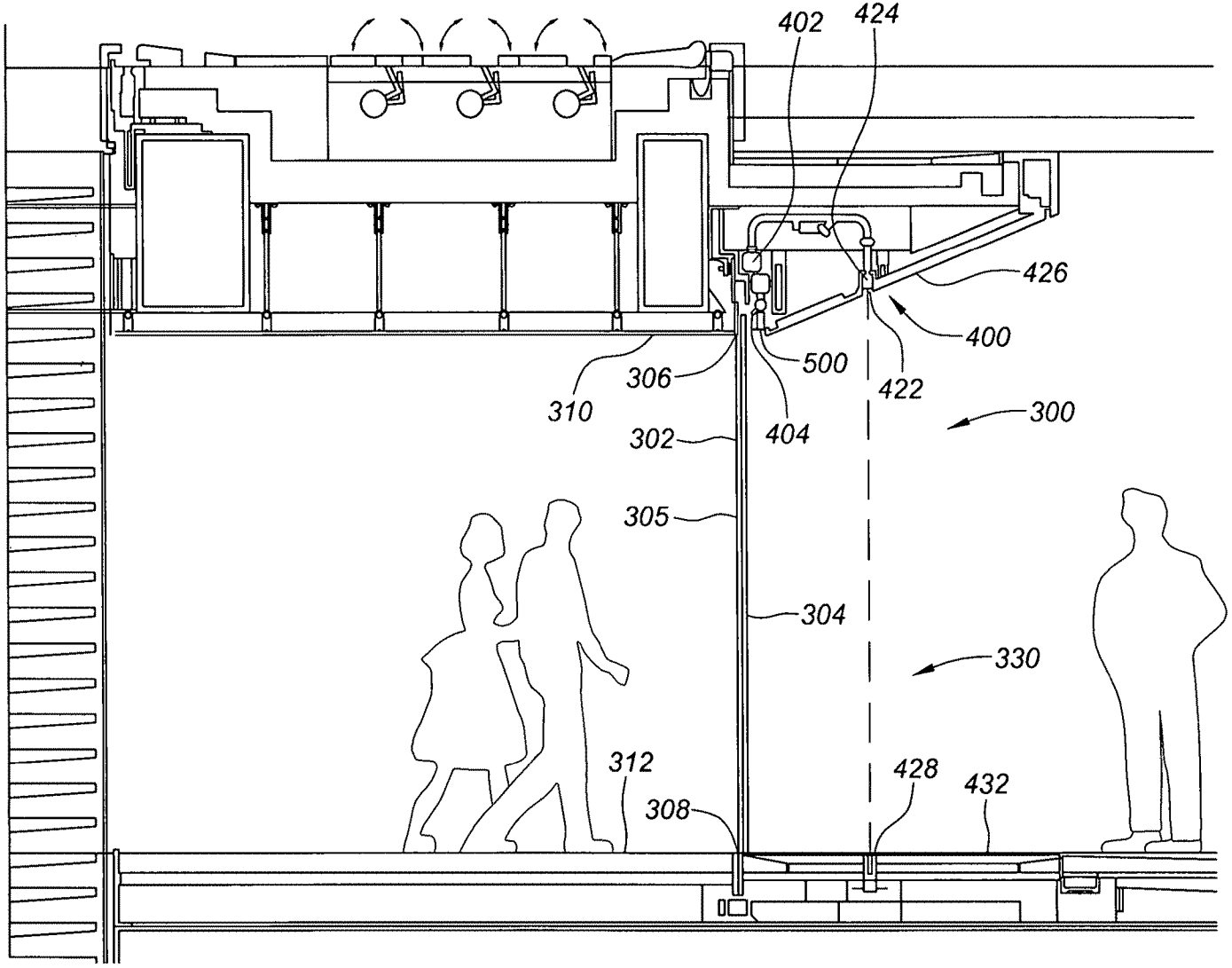
FIG. 17 shows a side view of a lower water wall.

In another embodiment, display 10 may include additional walls or structures with associated water delivery assemblies such as lower water wall 300 and water delivery assembly 400 as depicted in FIG. 16 and FIG. 17. The additional walls or structures and water delivery assemblies may be generally located in any position with respect to water wall 100 such as next to water wall 100, behind it, in front of it, above it, below it, or in any other location. For example, FIGS. 16 and 17 depict an additional wall 300 and water delivery assembly 400 generally located below water wall 100. Wall 300 may also include lighting assembly 500 that may serve to illuminate the wall 300 and associated water during the day or night.

In general, water may be delivered to the surfaces of wall 300 or to an area in front of or behind the surfaces of wall 300 by water delivery assembly 400. This will be described in later sections.

In the embodiment shown in FIGS. 16 and 17, wall or structure 300 may include a water wall 302 with a front surface 304 and a back surface 305. Wall 302 may be formed of a transparent material such as glass, Polycarbonate or any other type of transparent material so that water delivered to the surfaces of or in front of or behind the surfaces of water wall 302 may be viewed from either side of the wall 302. Or conversely, wall 300 may be opaque or solid. In addition, wall 300 may include engravings, etchings, channels or other types of structures in its surfaces that may guide water as it flows down the wall. These may include logos or letters or other types of shapes, patterns and forms. Also, wall 300 may be smooth or may include textures or other types of surface characteristics.

As depicted, water wall 302 may generally extend from the floor surface 312 to the ceiling surface 310 such that patrons may stand in front of, behind or to the side of water wall 302 while viewing the display. In this configuration, wall 302 may be held securely to the floor 312 by holders 308 and to the ceiling by holders 306. Note however, that water wall 302 may be configured in other positions so that it may not extend all the way from the floor to the ceiling. For example, wall 302 may be secured to the floor with holders 308 and extend upward to a position below ceiling 310. Or, wall 302 may be secured to the ceiling by holders 306 and extend downward to a position above floor 312. It should also be noted that while FIGS. 16 and 17 depict wall 302 as being generally vertical, wall 302 may also be at an angle, slanted or in other configurations with respect to the floor and the ceiling. Wall 302 may also be divided into sections that may be at any position with respect to one another.

Water delivery assembly 400 may include a water manifold 402 that may receive water from a water source and deliver the water to the front 304 or back 305 surfaces of the wall 302 so that the water flows down the surfaces of the wall 302. In addition, water pool 432 may be generally located at the base of wall 302 to receive water from wall 302 and may include a water uptake (not shown) that may return the water to the manifold 402. In one embodiment, water manifold 402 may be positioned generally at the top or above wall 302 and may generally extend across the upper dimension the wall 302. In addition, water manifold 402 may be configured with a variety of different water delivery devices 404 such as water holes, water droppers, water shooters, water nozzles, water sprayers, water fall delivery devices, water misters, and other types of water delivery devices to deliver the water accordingly. Note that water manifold 402 may also be configured to stretch across only a portion of the dimension of wall 302, may be configured to stretch across other areas of wall 302 such as the middle or the bottom or other areas, or may be configured in any other position or dimension with respect to wall 302.

Figure 18:
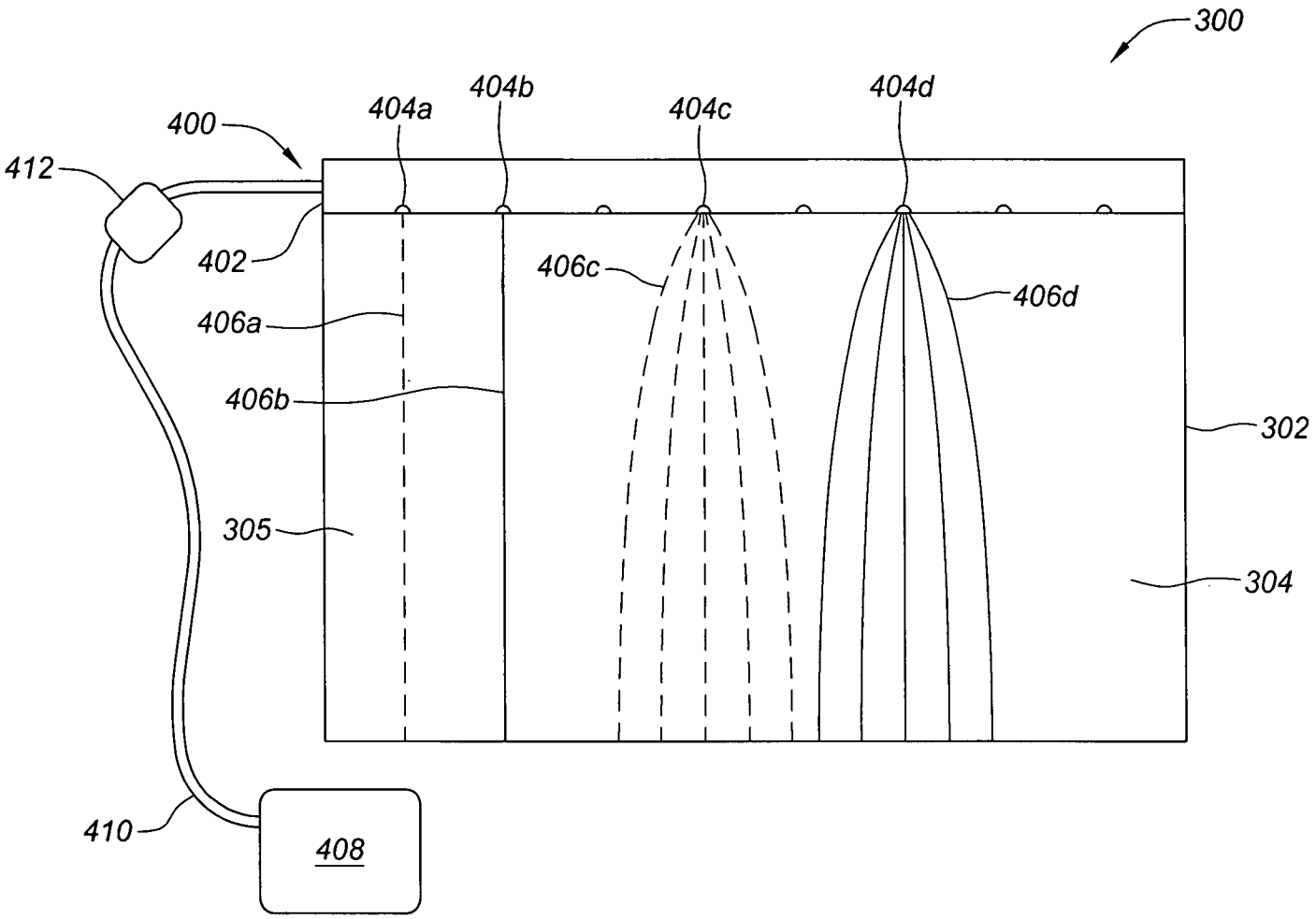
FIG. 18 shows a front view of a water display including a water wall with water delivery devices.

In one embodiment, these various water delivery devices 404 may be configured to deliver water directly to the front surface 304 or the back surface 305 of water wall 302. For example, as shown in FIG. 18, water delivery devices 402 may comprise water holes 404*a*, 404*b*, 404*c* and 404*d* that may include small openings in water manifold 402 that may release water from water manifold 402 to the front surface 304 of the wall 302. In this example, water holes 404*a*-404*d* may be configured to deliver water to water wall 302 as different types of water streams or water configurations. For example, water hole 404*a* may deliver water droplets 406*a* that may drip onto the wall 302. In another example, water hole 404*b* may deliver water stream 406*b* that may flow onto wall 302. In yet another example, water hole 404*c* may deliver water droplet bloom 406*c* that may comprise a variety of water droplets that may form different shapes (such as a bloom) as they drip onto and flow down water wall 302. In an additional example, water hole 404*d* may deliver water bloom 406*d* that may comprise a variety of water streams that may form different shapes, or one or more laminar streams that may form different shapes, as they flow onto and down wall 302.

Note that FIG. 18 is meant to represent a sample configuration of the different types of water holes 404*a*-404*d*, positionings and configurations that may be configured with water manifold 402 and water wall 302, and that any other configurations of water holes 404*a*-404*d* may also be included. For instance, water holes 404*a*-404*d* may be configured such that only one type of water hole 404*a*-404*d* is utilized across the wall 302. Or, a variety of different types of water holes 404*a*-404*d* may be utilized in any number and order across the wall that may be desired. Also, water holes 404*a*-404*d* may be evenly spaced across wall 302 or may be placed in uneven spacings or in groups. In addition, water holes 404*a*-404*d* may be positioned such that their respective water droplets or streams may remain independent as they are delivered to the wall 302 and as they flow down the wall 302, or they may be configured such that the water droplets or streams overlap as they flow down the wall so as to create a variety of different shapes and patterns of flowing water.

Water may be delivered to water manifold 402 from water supply 408 via water delivery network 410. Water supply 408 may include water pool 432, a water tank, a water reservoir, a neighboring water fountain, a pond, a lake or any other type of water supply. In addition, water delivery network 410 may include water pipes, tubes, channels or other types of liquid delivery mechanisms. Accordingly, water may flow from water supply 408 into water manifold 402 and out of water delivery devices 404. The water flow and pressure into water manifold 402 and out of water delivery devices 404 may be controlled by a water pump 412 that may be configured with water delivery network 410 and powered and controlled by a variable frequency drive (VFD) or other type of pressure and flow control device.

The water pump 412 and variable frequency drive (VFD) may be controlled either manually or by a controller (for example, a computer running software) in real time such that the water pressure and flow rate out of water pump 412 and into the water manifold 402 may also be dynamically controlled. This may in turn control and vary the water pressure and flow rate of the water as it emits from water holes 404*a*-404*d* such that the shapes and configurations of the water droplets or streams delivered to wall 302 may also be controlled to vary in real time. For instance, the water droplets 406*a* emitting from water dropper 404*a* may increase or decrease in frequency, the water droplets 406*a* may enlarge or shrink in size, or other characteristics of the water droplets 406*a* may be controlled. In addition, the characteristics of water streams and blooms 406*b*, 406*c*, 406*d* emitting from water holes 404*b*, 404*c*, 404*d* respectively may also be controlled in real time in a similar fashion.

It should also be noted that water delivery assembly 400 may include more than one water manifold 402, each with water delivery devices 404 configured to deliver water to wall 302. For example, several water manifolds 402 may be positioned above one another, side-by-side, in rows or in other configurations with respect to one another. In addition, each manifold 402 may include one or more water pumps 412 that may control the water pressure and flow rate of water into and out of individual water delivery devices 404 or groups of water delivery devices 404. As such, it can be seen that the shapes and other water characteristics of water flowing out of water delivery devices 404 (in this example, water holes 404*a*-404*d*) may be controlled individually or in groups in real time. Given this, different varying flow patterns on the front surfaces 304 of the wall 302 may be created across the wall 302. It is important to note that all of this may be controlled manually or by a controller, such as a computer, that may be running software. The software may control the water flow and output pressure in choreographed sequences such that the water patterns and shapes across the wall may be orchestrated to dance across the wall 302. Music may also be played and the orchestrated flow patterns may move in time with the music producing a dramatic water display effect. It should also be noted however that the water flow pattern across the wall 302 may also be an even expression.

Figure 19:
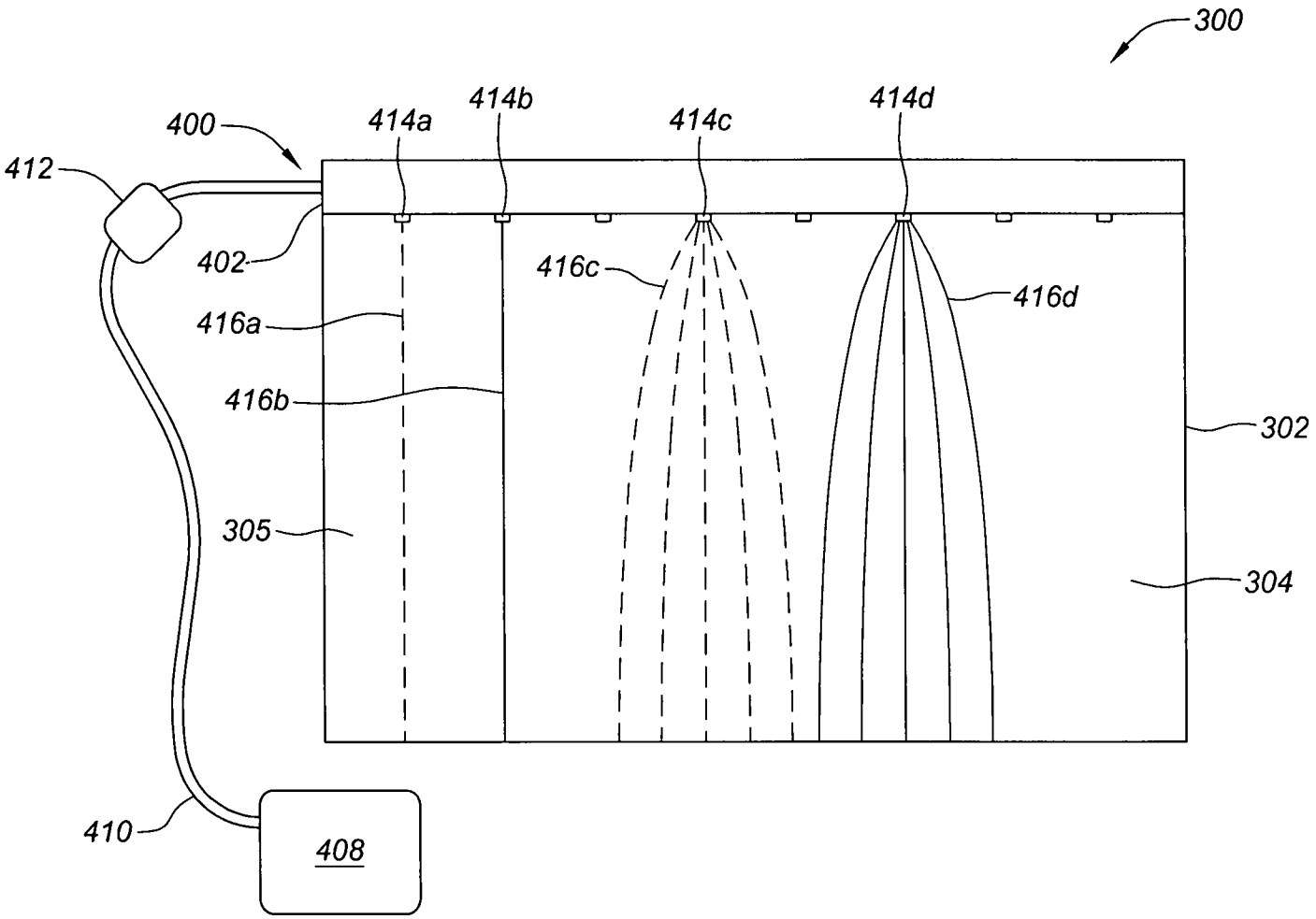
FIG. 19 shows a front view of a water display including a water wall with different water delivery devices.

In another embodiment as depicted in FIG. 19, water manifold 402 may be configured with water delivery devices 404 that may include water shooters or water nozzles 414*a*, 414*b*, 414*c*, 414*d* that may emit water droplets 416*a*, water streams 416*b*, water droplet blooms 416*c*, water stream blooms 416*d* and other types of water flows and shapes. Water nozzles 414*a*, 414*b*, 414*c*, 414*d* may be configured, positioned, operated and controlled as described above with respect to water holes 404*a*, 404*b*, 404*c*, 404*d*, and may be configured with one or more water manifolds 402 with one or more water pumps 412 as described above. In addition, water nozzles 414*a*, 414*b*, 414*c*, 414*d* may also have the ability to rotate, swivel and otherwise move in three dimensions so as to vary the angle of emitted water as it leaves the water nozzles 414*a*, 414*b*, 414*c*, 414*d* and is delivered to the wall 302. In addition, the nozzles 414*a*, 414*b*, 414*c*, 414*d* may have the ability to vary the water pressure as the water emits from the nozzles 414*a*, 414*b*, 414*c*, 414*d* to increase or decrease the velocity of the emitted water. The water nozzles 414*a*, 414*b*, 414*c*, 414*d* may also be able to dynamically vary the shape of the emitted water. The angle and position of the nozzles 414*a*, 414*b*, 414*c*, 414*d*, and the shape and output pressure settings of the nozzles 414*a*, 414*b*, 414*c*, 414*d* may be controlled in real time manually or with a controller that may run software. In this way, nozzles 414*a*, 414*b*, 414*c*, 414*d* may add an additional dramatic effect to water display 10 by including water shape control, water velocity/pressure control and further spatial control of the water droplets, streams and blooms in an orchestrated manner.

Figure 20:
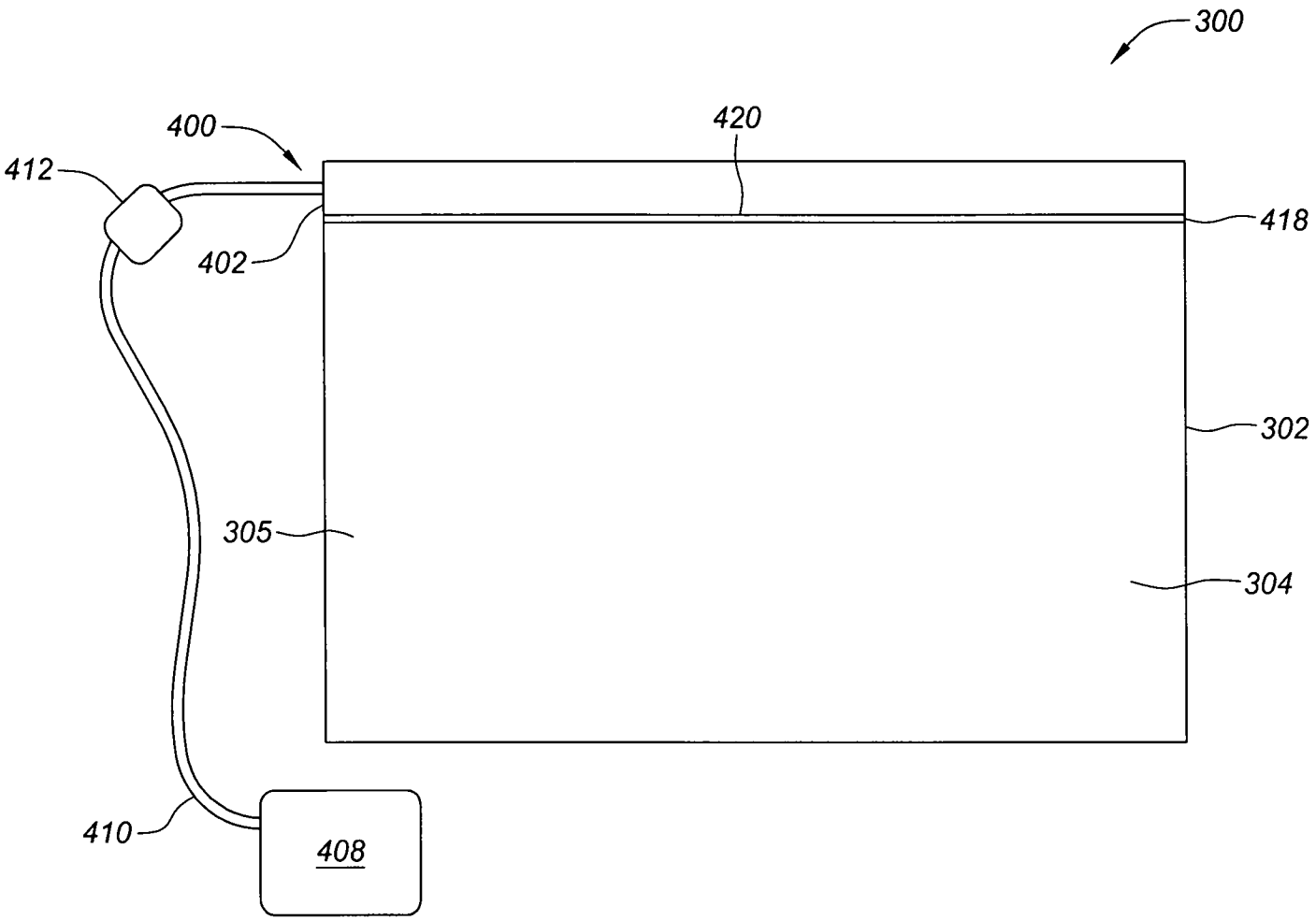
FIG. 20 shows a front view of a water display including a water wall with a different water delivery device.

In yet another embodiment, water manifold 402 may be configured with water fall device 418 as depicted in FIG. 20. Water fall device 418 may include one or more basins, channels or troughs that water may flow into, fill up, and then spill out of and onto water wall 302. Water fall device 418 may include front lip 420 over which water may spill out of and onto wall 302. It should be noted that water fall device 418 may be configured, positioned, operated and controlled as described with water holes 404*a*, 404*b*, 404*c*, 404*d* and water nozzles 414*a*, 414*b*, 414*c*, 414*d*.

It should be noted that with respect to all of the embodiments described above, while FIGS. 18, 19 and 20 primarily depict water being delivered to the front surface 304 of water wall 302, water manifold 402 may also be configured with water delivery devices 404 to deliver water to the back surface 305 of the wall 302, or to any other surface of the wall 302.

Figure 21:
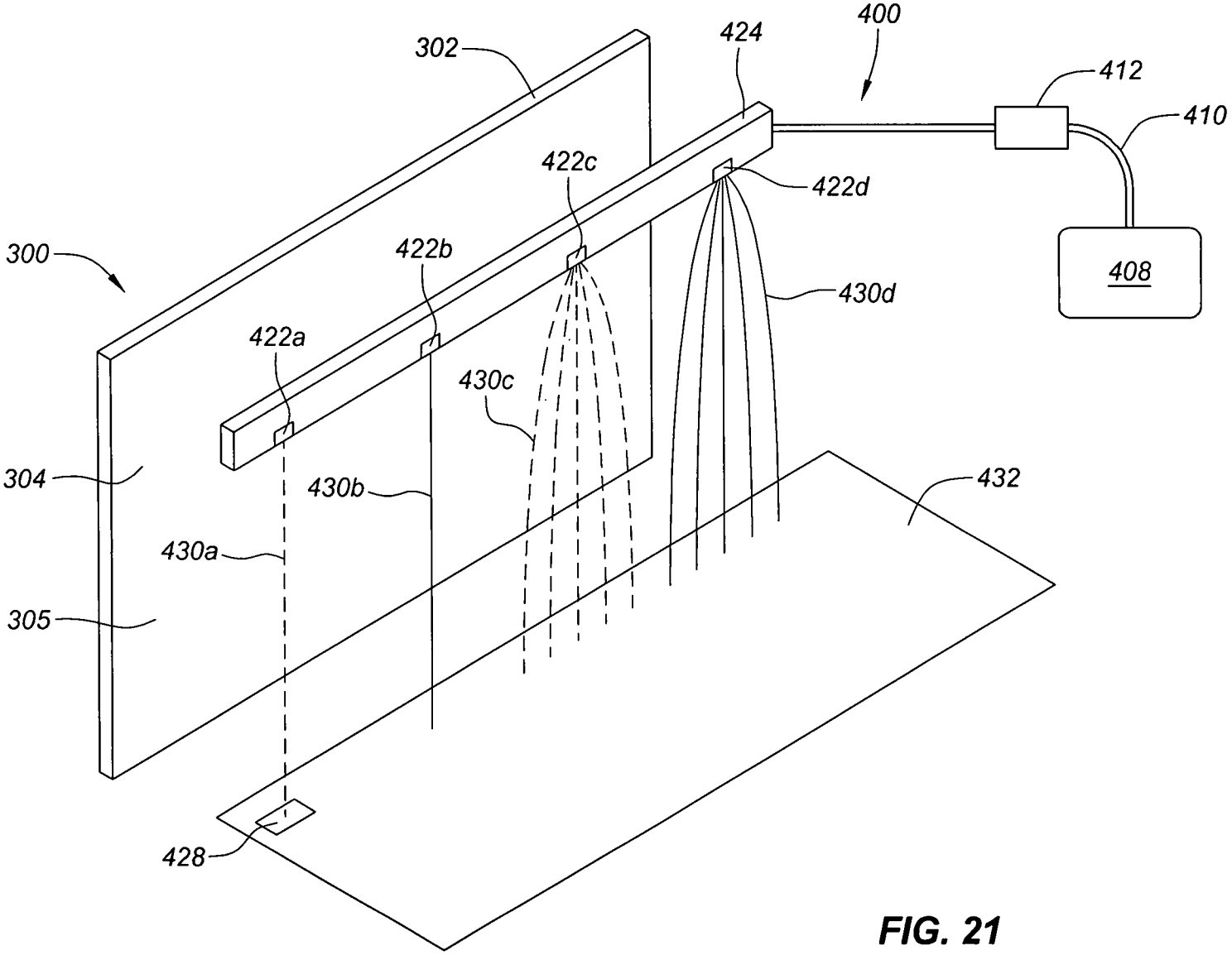
FIG. 21 shows a perspective view of a water display including an offset water manifold.

In another embodiment as depicted in FIG. 21, water delivery assembly 400 may include water manifold 424 that may be generally positioned to deliver water in close proximity to the wall 302, either in front of the wall 302 or behind it, but not actually onto the surfaces 304, 305 of the wall 302. Water manifold 424 may be configured, positioned, controlled and operated the same as water manifold 402 as described above, but water manifold 424 may be offset from wall 302 (either in front or behind the wall 302) such that water emitted by water manifold 428 may fall through the air in front of or behind the wall 302. In the example shown in FIG. 21, water manifold 424 is configured in front of the wall 302. The offset spacing may range from less than an inch to several feet. This way, water falling in front of or behind the wall 302 may create a dramatic effect for viewers on either side of the wall 302. Note that water manifold 424 may also be configured behind wall 302.

In addition, similar to water manifold 402, water manifold 424 may be configured with water delivery devices 422 that may include water holes, water droppers, water shooters, water nozzles, water sprayers, water fall delivery devices, water misters, and other types of water delivery devices. FIG. 21 depicts these different types of water deliver devices 404 as device 422*a* delivering water droplets 430*a*, device 422*b* delivering water stream 430*b*, device 422*c* delivering water droplet bloom 430*c* and device 422*d* delivering water bloom 430*d*. However, just as with embodiments described above with respect to water manifold 402, water manifold 424 may be configured with any type of water delivery device 404 or combination of water delivery devices 404 to create any type of water stream, shape or form. Note also that water delivery devices 404 configured with water manifold 424 may be configured, positioned, controlled and operated the same as the water delivery devices described in relation to water manifold 402 above.

Water may fall from water manifold 424 downward through the air and into water pool 432. In addition, pool 432 may include a water uptake (not shown) that may receive the water from water manifold 424 and return it to the manifold 424 to be recycled. Also, water receiving device 428 may also be positioned beneath the path of the emitted water from water manifold 424 to receive the emitted water and to regulate the water flow out of the manifold 424. For example, water receiving device 428 may include sensors that may measure or otherwise keep track of the water flow rate received by the water receiving device 428 such that the device 428 may relay this information to a controller that may use the data to control and regulate the water pressure and flow rate of water entering into and out of water manifold 424.

As described above, water display 10 may also including lighting assembly 500 that may be configured to illuminate water wall 302 and the water as it flows down the wall 302 or as it falls through the air in close proximity to the wall 302. Lighting assembly may comprise flood lights, LEDs, optical fibers or other types of light sources that may be aimed onto the wall 302 or onto the water that is emitted by water manifolds 402 and/or 428 and the associated water delivery devices 404. In addition, the light sources may be generally positioned above wall 302 as depicted in FIG. 17 or may be configured below the wall 302 (not shown) or in any other position with regard to water wall 302 and the emitted water from water manifolds 402 and/or 428 and the associated water delivery devices 404. Lighting assembly 500 may be controlled manually or by a controller, such as a computer running software, such that the lighting sequences may be controlled, orchestrated and choreographed with the other elements of the water display 10 such as the velocity, shape, direction and other configurations of the water droplets and water streams that may be emitted by water manifolds 402 and 428 with associated water delivery devices 404.

Although certain presently preferred embodiments of the invention have been described herein, it will be apparent to those skilled in the art to which the invention pertains that variations and modifications of the described embodiments may be made without departing from the spirit and scope of the invention.

What is claimed is:

1. A multi-level water display, comprising:

a first level including a first wall that has a top edge, that has a front surface and a rear surface which terminate at the top edge, that is transparent and that is positioned for observation by one or more observers from the front surface and the rear surface;

a nozzle that emits a water stream at a trajectory at the first wall;

wherein the water stream intersects the front surface and subsequently travels down the front surface to provide a first visual effect that is observable from the front surface and the rear surface;

a floor on which one or more observers may stand or walk and that is located to allow one or more observers to observe the first visual effect:

a second level that includes a second wall, a water delivery device which is positioned at or near the top of the second wall and which is configured to deliver water to the front or back of the second wall so that the water subsequently travels down the wall to provide a second visual effect;

a second floor on which one or more observers may stand and that is located to allow one or more observers to observe the second visual effect; and the first wall and/or the second wall extends above the one or more observers.

2. The display of claim 1, wherein the angle of the nozzle is adjusted to change the trajectory of the water stream.

3. The display of claim 1, wherein the exit velocity of the water stream emanating from the nozzle is varied, thereby changing the trajectory of the water.

4. The display of claim 1, wherein the angle of the nozzle and/or the exit velocity of the water stream are adjusted to change the trajectory of the water stream, and wherein the trajectory of the water stream determines the intersection point of the water stream and the first wall.

5. The display of claim 1, wherein the water delivery device is positioned to receive water from the first level to deliver the water to the front or back of the second wall.

6. The display of claim 1, wherein the first level includes an additional wall that is located so that the floor is between the first wall and the additional wall.

7. The display of claim 1, further comprising a plurality of nozzles that emit water streams at one or more trajectories.

8. The display of claim 7, wherein the angle of the nozzles and/or the exit velocity of water emanating from the nozzles are adjusted to change the trajectory of the water streams.

9. The display of claim 8, wherein the angle of the nozzles and the exit velocity of the water stream are simultaneously adjusted to change the trajectory of the water stream.

10. A water display, comprising:

a wall that has a top edge, that has a front surface and a rear surface which terminate at the top edge, that is transparent and that is positioned for observation by one or more observers from the front surface and the rear surface;

a manifold that includes a plurality of nozzles which emit water streams at the front surface;

a controller that controls the manifold to vary the angle at which the nozzles emit the water streams to correspondingly vary the distance the water streams travel to the front surface and/or that controls the exit velocity of the water emanating from the nozzles in a coordinated manner to create a visual effect;

a floor that is fixedly attached to the display, on which one or more observers may stand or walk and that is located to allow one or more observers to observe the visual effect;

wherein the wall comprises a tunnel that is above the floor and that is configured for one or more observers to walk through; and wherein the water streams intersect the front surface and subsequently travel down the front surface thereby providing the visual effect that is observable from the front surface and the rear surface.

11. The water display of claim 10, wherein the controller simultaneously controls the manifold to vary the angle at which the nozzles emit water streams to correspondingly vary the distance the water streams travel to the surface and the exit velocity of the water emanating from the nozzles.

12. The water display of claim 10, further comprising a second manifold that includes a plurality of nozzles which emit water streams at the surface.

13. The water display of claim 12, wherein the second manifold is controlled by the controller or a second controller.

14. The water display of claim 13, wherein the controller and/or second controller operate under computer control.

15. The water display of claim 10, wherein the wall is transparent.

16. The water display of claim 10, further comprising lighting, and wherein the water streams are choreographed with the lighting.

17. The water display of claim 10, further comprising music, and wherein the waters streams are choreographed with the music.

* * * * *